US005904411A

United States Patent [19]

Hayakawa

[11] Patent Number: 5,904,411

[45] Date of Patent: May 18, 1999

[54] CABINET DOOR PROP UNIT

[75] Inventor: Tatsuya Hayakawa, Tokyo, Japan

[73] Assignee: Sugatsune Industrial Co., Ltd., Tokyo, Japan

[21] Appl. No.: 08/855,996

[22] Filed: May 14, 1997

[30] Foreign Application Priority Data

May 14, 1996 [JP] Japan ..... 8-143507
May 15, 1996 [JP] Japan ..... 8-144999

[51] Int. Cl.[6] ..... A47B 88/00

[52] U.S. Cl. ..... 312/319.2; 312/323; 16/289; 49/386

[58] Field of Search ..... 312/323, 319.2; 16/289; 49/386

[56] References Cited

U.S. PATENT DOCUMENTS

| | | | |
|---|---|---|---|
| 2,198,346 | 4/1940 | Little | 16/298 X |
| 2,388,654 | 11/1945 | Holmes | 49/206 |
| 3,209,392 | 10/1965 | Levine | 16/289 |
| 5,079,797 | 1/1992 | Ohshima | 16/82 |
| 5,271,652 | 12/1993 | Watanabe et al. | 16/289 X |
| 5,458,412 | 10/1995 | Lee et al. | 312/319.2 X |
| 5,513,420 | 5/1996 | Kennedy | 16/289 |
| 5,524,979 | 6/1996 | Carson et al. | 312/319.2 |
| 5,758,937 | 6/1998 | Lammens et al. | 312/323 X |

FOREIGN PATENT DOCUMENTS

| | | | |
|---|---|---|---|
| 378919 | 8/1907 | France | 49/386 |
| 647198 | 10/1962 | Italy | 16/289 |
| 60-18528 | 6/1985 | Japan . | |

*Primary Examiner*—Peter M. Cuomo
*Assistant Examiner*—David E. Allred
*Attorney, Agent, or Firm*—Jacobson, Price, Holman & Stern, PLLC

[57] ABSTRACT

An over-the-top type cabinet door prop unit is characterized in that it comprises a fitting case to be rigidly fitted to the inner surface of one of the lateral walls of the cabinet, a movable spring holder vertically movable relative to the fitting case containing it and urged downward by compression springs, a link arm pivotably linked at the upper end to the movable spring holder by a pivot pin and a swing arm swingable around an arm spindle located in a lower portion of the fitting case and having a base section arranged around the arm spindle and linked to the lower end of said link arm by a link pin and an arm section extending from the base section and pivotably linked at the distal end thereof by an anchor pin to an anchor pin bearing secured to the over-the-top type cabinet door and that the pivot where the link arm and the base section of the swing arm is linked by the link pin is located closer to the cabinet door relative to the vertical axial line connecting the pivot pin and the arm spindle when the over-the-top type cabinet door is closed and moved onto the vertical axial line in the initial stages of the opening motion of the cabinet door and then further away from the cabinet door relative to the vertical axial line in the subsequent stages of the opening motion of the cabinet door until the cabinet door is placed on the top wall of the cabinet.

4 Claims, 18 Drawing Sheets

CABINET DOOR PROP UNIT

BACKGROUND OF THE INVENTION

1. Field of the Invention

This invention relates to a cabinet door prop unit to be used for the door of a piece of storage furniture such as a storage cabinet, that may be an over- or under-the-top type door with a hinge mechanism, a pull-down-and-open type door, a pull-up-and-open type door, a swing-sideways type door or a door of any other relevant type as will be described hereinafter, in order to absorb the energy of the moving door and prevent it form slamming shut simply by fitting it to the door, on one hand, and also to the inner wall surface of one of the lateral walls, the top wall or the bottom wall, whichever appropriate, of the cabinet main body so that the door may be opened and closed easily, slowly and comfortably.

2. Prior Art

FIG. 18 of the accompanying drawings schematically illustrates a known under-the-top type cabinet door with a hinge mechanism, with which the door a can be opened and temporarily stored under the top wall c of the cabinet main body b (Japanese Utility Model Application Laid-Open No. 60-18528). Such a known door arrangement has the drawback that the door a has to be fitted and positionally regulated properly with toil because the slide mechanism of the door including a slide rail g and a roller h is located within the cabinet and the internal storage space of the cabinet main body b is reduced by the door a that is stored inside the cabinet main body b when it is opened in addition to the fact that a support arm d and a short arm e have to be fitted to the door a and the cabinet main body b and a coil spring has to be arranged between the door a and the short arm e in order to make the door operate properly.

Additionally, the support arm d and the spring f become exposed to the outside to damage the appearance of the storage cabinet when the door a is opened and the user may have one or more than one of his or her fingers smashed between the spring f and the support arm d by mistake.

SUMMARY OF THE INVENTION

The present invention is intended to resolve the above identified problem and other problems of prior art cabinet doors. In the first aspect of the present invention, it is an object thereof to provide a cabinet door prop unit with a hinge mechanism for an over-the-top type cabinet door designed to be opened by turning the lower end thereof upward until it is placed on the top wall of the cabinet once the fitting case of the prop unit is rigidly fitted to the inner surface of one of the lateral walls of the cabinet and the distal end of the swing arm of the unit extending from the fitting case and swingable around an arm spindle is pivotably fitted to an anchor pin supported by an anchor pin bearing of the door.

Another object is to make the door prop unit comprise a movable spring holder constantly urged downward by a number of compression springs, a link arm pivotably fitted to the movable spring holder at the upper end thereof and to a base section of the swing arm swingable around the arm spindle at the lower end thereof by means of a link pin to transmit appropriate rotary force to the swing arm so that the door may be held to its closed position once it is closed and opened and stored easily on the top wall of the cabinet when only little force is applied thereto to open it by utilizing the resilient force of the compression springs. With such an arrangement, the door prop unit has a neat appearance and is free from the risk of smashed fingers because the compression springs and other components are not exposed to the outside.

In the second aspect of the invention, a cabinet door prop unit as described above in terms of the first aspect of the invention is provided with a damper mechanism for damping and slowing the swinging motion of the swing arm without requiring any user's effort when the cabinet door is closed.

In the third aspect of the invention, the resilient force of the compression springs of a cabinet door prop unit as described above in terms of the first aspect of the invention may be temporarily suspended for the convenience of the user so that the door may be stored on the top wall of the cabinet manually and slowly after it is fully opened and pulled out from the top wall also manually and slowly for closing it.

In the fourth aspect of the invention, a cabinet door prop unit according to the third aspect of the invention is provided with a damper mechanism for damping and slowing the swinging motion of the swing arm without requiring any user's effort when the cabinet door is closed so that the door may be prevented from slamming shut.

In the fifth aspect of the present invention, it is an object thereof to provide a cabinet door prop unit with a hinge mechanism for a pull-down-and open type cabinet door designed to be opened by pulling down the top of the door once the fitting case of the prop unit is rigidly fitted to the inner surface of one of the lateral walls of the cabinet and the distal end of the extension arm articulated at the proximal end thereof to the distal end of the swing arm of the unit extending from the fitting case and swingable around an arm spindle is pivotably fitted to an anchor pin supported by an anchor pin bearing of the door.

Another object is to make the door prop unit comprise a movable spring holder constantly urged upward by a number of compression springs, a link arm pivotably fitted to the movable spring holder at the lower end thereof and to a base portion of the swing arm at the upper end thereof by means of a link pin to transmit appropriate rotary force to the swing arm so that the door may be held to its closed position once it is closed by way of the extension arm and opened slowly when only appropriate force is applied thereto to open it by utilizing the resilient force of the compression springs. With such an arrangement, the door prop unit has a neat appearance and is free from the risk of smashed fingers because the compression springs and other components are not exposed to the outside.

In the sixth aspect of the invention, a cabinet door prop unit as described above in terms of the fifth aspect of the invention is provided with a damper mechanism for damping and slowing the swinging motion of the swing arm without requiring any user's effort when the cabinet door is opened.

In the seventh aspect of the present invention, it is an object thereof to provide a cabinet door prop unit with a hinge mechanism for a pull-up-and-open type top cabinet door designed to be opened by pulling up the free end of the door once the fitting case of the prop unit is rigidly fitted to the inner surface of one of the lateral walls of the cabinet and the distal end of the extension arm articulated at the proximal end thereof to the distal end of the swing arm of the unit extending from the fitting case and swingable around an arm spindle is pivotably fitted to an anchor pin supported by an anchor pin bearing of the door.

Another object is to make the door prop unit comprise a movable spring holder constantly urged sideways by a number of compression springs, a link arm pivotably fitted to the movable spring holder at one of its opposite ends and to a base section of the swing arm at the other end thereof by means of a link pin to transmit appropriate rotary force to the swing arm so that the door may be held to its closed position once it is closed by way of the extension arm and opened slowly when only little force is applied thereto to open it by utilizing the resilient force of the compression springs. With such an arrangement, the door prop unit has a neat appearance and is free from the risk of smashed fingers because the compression springs and other components are not exposed to the outside.

In the eighth aspect of the invention, a cabinet door prop unit as described above in terms of the seventh aspect of the invention is provided with a damper mechanism for slowing and damping the swinging motion of the swing arm without requiring any user's effort when the cabinet door is closed from its open position.

In the ninth aspect of the present invention, it is an object thereof to provide a cabinet door prop unit with a hinge mechanism for a pull-up-and-open type front side cabinet door designed to be opened by pulling up the free end of the door once the fitting case of the prop unit is rigidly fitted to the inner surface of one of the lateral walls of the cabinet and the distal end of the extension arm articulated at the proximal end thereof to the distal end of the swing arm of the unit extending from the fitting case and swingable around an arm spindle is pivotably fitted to an anchor pin supported by an anchor pin bearing of the door.

Another object is to make the door prop unit comprise a movable spring holder constantly urged upward by a number of compression springs, a link arm pivotably fitted to the movable spring holder at the lower end thereof and to a base section of the swing arm at the upper end thereof by means of a link pin to transmit appropriate rotary force to the swing arm so that the door may be held to its closed position once it is closed by way of the extension arm and opened fully by the resilient force of the compression springs without requiring much force on the part of the user once the door is opened to a small extent. Additionally, the door can constantly be held to its open position by the compression springs once the door is opened to make the swing arm and the extension arm aligned relative to each other. With such an arrangement, the door prop unit has a neat appearance and is free from the risk of smashed fingers because the compression springs and other components are not exposed to the outside.

In the tenth aspect of the invention, a cabinet door prop unit as described above in terms of the ninth aspect of the invention is provided with a damper mechanism for slowing and damping the swinging motion of the swing arm without requiring any user's effort when the cabinet door is closed from its open position.

In the eleventh aspect of the invention, it is an object to provide a cabinet door prop unit with a hinge mechanism for a cabinet pull-sideways-and open type door designed to be opened and closed in an easy way as described above by appropriately arranging compression springs, a movable spring holder, a link arm, an arm spindle, a swing arm, a pivot pin, a link pin and other components such that the door may be held to its closed position whereas it may be opened and held to its fully open position with little effort due to the resilient force of the compression springs. With such an arrangement, the door prop unit has a neat appearance and is free from the risk of smashed fingers because the compression springs and other components are not exposed to the outside. In the twelfth aspect of the invention, a cabinet door prop unit as described above in terms of the eleventh aspect of the invention is provided with a damper mechanism for damping and slowing the swinging motion of the swing arm without requiring any user's effort.

The thirteenth aspect of the present invention relates to a cabinet door prop unit with a hinge mechanism for a pull-up-and-store-under-the-door type front side cabinet door as in the fitting case of the ninth aspect of the invention, although the door can be not only opened by pulling up the lower free end of the door but also stored under the top wall of the cabinet simply by pushing it into the cabinet once the door is turned upward to a horizontal position.

Here, the fitting case of the prop unit is fitted not directly to the inner surface of one of the lateral walls of the cabinet but rigidly to a bracket that is horizontally slidable along a sliding rail assembly having an outer rail and an inner rail and arranged on the inner surface of the lateral wall in such a way that the bracket and the door are articulated by means of not a simple hinge mechanism but a sliding hinge mechanism and the swing arm extending from the fitting case and swingable around an arm spindle is articulated further to an extension arm so that the under-the-top type door may be operated with ease once the distal end of the extension arm is pivotably fitted to an anchor pin supported by an anchor pin bearing of the door.

Another object is to make the door prop unit adapted to transmit appropriate rotary force to the swing arm in order to make it held to its closed position once it is closed by way of the extension arm and fully opened by the resilient force of the compression springs without requiring much force on the part of the user once the door is opened to a small extent. Additionally, the door can constantly be held to its open position by the compression springs and the sliding hinge mechanism and the door can be pushed into the cabinet smoothly by means of the slide rails and the bracket once the door is opened to make the swing arm and the extension arm aligned relative to each other.

In the fourteenth aspect of the invention, a cabinet door prop unit as described above in terms of the thirteenth aspect of the invention is provided with a damper mechanism for damping and slowing the swinging motion of the swing arm without requiring any user's effort as in the fitting case of the tenth aspect of the invention, wherein the cabinet door prop unit according to the ninth aspect of the invention is provided with a damper mechanism. According to the present invention, the above described objects of the first aspect are achieved by providing an over-the-top type cabinet door prop unit characterized in that it comprises a fitting case to be rigidly fitted to the inner surface of one of the lateral walls of the cabinet, a movable spring holder vertically movable relative to the fitting case containing it and urged downward by compression springs, a link arm pivotably linked at the upper end to the movable spring holder by means of a pivot pin and a swing arm swingable around an arm spindle located in a lower portion of the fitting case and having a base section arranged around the arm spindle and linked to the lower end of said link arm by means of a link pin and an arm section extending from the base section and pivotably linked at the distal end thereof by means of an anchor pin to an anchor pin bearing secured to the over-the-top type cabinet door and that the pivot where the link arm and the base section of the swing arm is linked by means of the link pin is located closer to the cabinet door relative to the vertical axial line in the connecting said pivot pin and said arm spindle when the over-the-top type cabinet door is closed and moved onto said vertical axial line in the initial stages of the opening motion of the cabinet door and then further away from the cabinet door relative to said vertical axial line in the subsequent stages of the opening motion of the cabinet door until the cabinet door is placed on the top wall of the cabinet.

The object of the second aspect of the invention are achieved by providing an over-the-top type cabinet door prop unit described above in terms of the first aspect and characterized further in that said arm spindle is linked to the rotary shaft of a damper mechanism arranged in the fitting case and designed to exert a damping effect on the closing or closing and opening motion of the cabinet door by means of viscous fluid.

According to the third aspect of the invention, there is provided an over-the-top type cabinet door prop unit having a configuration according to the first aspect of the invention and characterized further in that the pivot where the link arm and the base section of the swing arm is linked by means of the link pin is located closer to the cabinet door relative to the vertical axial line connecting said pivot pin and said arm spindle when the over-the-top type cabinet door is closed and moved onto said vertical axial line in the initial stages of the opening motion of the cabinet door and then further away from the cabinet door relative to said vertical axial line in the subsequent stages of the opening motion of the cabinet door down to the final stages of the opening motion of the cabinet door and that a vertical slot is arranged within said movable spring holder in such a way that said downwardly urging motion of said compression springs is blocked at a limit by the fitting case and the pivotal position of the pivot pin may be lowered by a required length from the original upper pivotal position as the cabinet door is opened by hand in the final stages of the opening motion of the cabinet door until the cabinet door is placed on the top wall of the cabinet.

According to the fourth aspect of the invention, there is provided an over-the-top type cabinet door prop unit according to the third aspect of the invention and characterized further in that said arm spindle is linked to the rotary shaft of a damper mechanism arranged in the fitting case and designed to exert a damping effect on the closing or closing and opening motion of the cabinet door by means of viscous fluid.

According to the fifth aspect of the invention, there is provided a pull-down-and-open type cabinet door prop unit characterized in that it comprises a fitting case to be rigidly fitted to the inner surface of one of the lateral walls of the cabinet, a movable spring holder vertically movable relative to the fitting case containing it and urged upward by compression springs, a link arm pivotably linked at the lower end to the movable spring holder by means of a pivot pin, a swing arm swingable around an arm spindle located in an upper portion of the fitting case and having a base section arranged around the arm spindle and linked to the upper end of said link arm by means of a link pin and an arm section extending from the base section and an extension arm linked at the proximal end to the distal end of said swing arm by means of a joint pin so as to be adapted to become aligned with said arm section or pivotable therefrom toward the opening of the cabinet and pivotably linked at the distal end thereof by means of an anchor pin to an anchor pin bearing secured to the pull-down-and-open type cabinet door and that the pivot where the link arm and the base section of the swing arm are linked by means of the link pin is located closer to the cabinet door relative to the vertical axial line connecting said pivot pin and said arm spindle and the arm section when the extension arm are oblique relative to each other to expand said compression springs the pull-down-and-open type cabinet door is closed, whereas said pivot is located substantially on said vertical axial line and the arm section and the extension arm are aligned as the movable spring holder is moved downward when the cabinet door hinged to the corresponding edge of the bottom wall of the cabinet is opened and made flush with the bottom wall.

According to the sixth aspect of the invention, there is provided a pull-down-and-open type cabinet door prop unit according to the fifth aspect of the invention and characterized further in that said arm spindle is linked to the rotary shaft of a damper mechanism arranged in the fitting case and designed to exert a damping effect on the closing or closing and opening motion of the cabinet door by means of viscous fluid.

According to the seventh aspect of the invention, there is provided a pull-up-and-open type top cabinet door prop unit characterized in that it comprises a fitting case to be rigidly fitted to the inner surface of one of the lateral walls of the cabinet, a movable spring holder horizontally movable relative to the fitting case containing it and urged toward the front wall of the cabinet by compression springs, a link arm pivotably linked at the end close to the rear wall of the cabinet to the movable spring holder by means of a pivot pin, a swing arm swingable around an arm spindle located in a portion of the fitting case close to the front wall of the cabinet and having a base section arranged around the arm spindle and linked to the end of said link arm close to the front wall of the cabinet by means of a link pin and an arm section extending from the base section and an extension arm linked at the proximal end to the distal end of said swing arm by means of a joint pin so as to be adapted to become aligned with said arm section or pivotable therefrom toward the opening of the cabinet and pivotably linked at the distal end thereof by means of an anchor pin to an anchor pin bearing secured to the pull-up-and-open type top cabinet door and that the pivot where the link arm and the base section of the swing arm is linked by means of the link pin is located between the pivot pin and the arm spindle and slightly away from the cabinet door relative to the horizontal axial line connecting said pivot pin and said arm spindle when the arm section and the extension arm are oblique relative to each other to compress said compression springs and the pull-up-and-open type top cabinet door is closed, whereas said pivot is located closer to the front wall of the cabinet relative to the arm spindle and away from the cabinet door relative to the horizontal axial line connecting said pivot pin and said arm spindle and the arm section and the extension arm are aligned and project upward to expand said compression springs as the movable spring holder is moved away from the cabinet door relative to said horizontal axial line when the pull-up-and-open type top cabinet door hinged to the upper edge of the rear wall of the cabinet is opened.

According to the eighth aspect of the invention, there is provided a pull-up-and-open type top cabinet door prop unit according to the seventh aspect of the invention and characterized further in that said arm spindle is linked to the rotary shaft of a damper mechanism arranged in the fitting case and designed to exert a damping effect on the closing or closing and opening motion of the cabinet door by means of viscous fluid.

According to the ninth aspect of the invention, there is provided a pull-up-and-open type cabinet door prop unit characterized in that it comprises a fitting case to be rigidly fitted to the inner surface of one of the lateral walls of the cabinet, a movable spring holder vertically movable relative to the fitting case containing it and urged downward by compression springs, a link arm pivotably linked at the upper end to the movable spring holder by means of a pivot pin, a swing arm swingable around an arm spindle located in a lower portion of the fitting case and having a base section arranged around the arm spindle and linked to the lower end of said link arm by means of a link pin and an arm section extending from the base section and an extension arm linked at the proximal end to the distal end of said swing arm by means of a joint pin so as to be adapted to become aligned with said arm section or pivotable therefrom toward the opening of the cabinet and pivotably linked at the distal end thereof by means of an anchor pin to an anchor pin bearing secured to the pull-up-and-open type cabinet door and that the pivot where the link arm and the base section of the swing arm are linked by means of the link pin is located closer to the cabinet door relative to the vertical axial line connecting said pivot pin and said arm spindle when the arm section and the extension arm are oblique relative to each other to compress said compression springs and the pull-up-and-open type cabinet door is closed, whereas said pivot is moved substantially onto said vertical axial line connecting said pivot pin and said arm spindle in the initial stages of opening the cabinet door hinged to the corresponding upper edge of the top wall and then further away from the cabinet door relative to said vertical axial line in the subsequent stages of opening the cabinet door until the arm section and the extension arm are aligned to expand the compression spring and complete the door opening operation.

According to the tenth aspect of the invention, there is provided a pull-up-and-open type cabinet door prop unit according to the ninth aspect of the invention and characterized further in that said arm spindle is linked to the rotary shaft of a damper mechanism arranged in the fitting case and designed to exert a damping effect on the closing or closing and opening motion of the cabinet door by means of viscous fluid.

According to the eleventh aspect of the invention, there is provided a pull-sideways-and-open type cabinet door prop unit characterized in that it comprises a fitting case to be rigidly fitted to the inner surface of either the top wall of the bottom wall of the cabinet, a movable spring holder horizontally movable relative to the fitting case containing it and urged toward the front wall of the cabinet door by compression springs, a link arm pivotably linked at the end close to the rear wall of the cabinet to the movable spring holder by means of a pivot pin, a swing arm swingable around an arm spindle located in a portion of the fitting case close to the front wall of the cabinet and having a base section arranged around the arm spindle and linked to the end of said link arm close to the front wall of the cabinet by means of a link pin and an arm section extending from the base section and an extension arm linked at the proximal end to the distal end of said swing arm by means of a joint pin so as to be adapted to become aligned with said arm section or pivotable therefrom toward the opening of the cabinet and pivotably linked at the distal end thereof by means of an anchor pin to an anchor pin bearing secured to the pull-sideways-and-open type cabinet door and that the pivot where the link arm and the base section of the swing arm are linked by means of the link pin is located closer to the cabinet door relative to the horizontal axial line connecting said pivot pin and said arm spindle when the arm section and the extension arm are oblique relative to each other to expand said compression springs and the pull-sideways-and-open type cabinet door is closed, whereas said pivot is moved substantially onto said horizontal axial line connecting said pivot pin and said arm spindle in the initial stages of opening the cabinet door hinged to the corresponding upper edge of the top wall to compress said compression springs and then further away from the cabinet door relative to said horizontal axial line in the subsequent stages of opening the cabinet door until the arm section and the extension arm are aligned to expand the expand spring and complete the door opening operation.

According to the twelfth aspect of the invention, there is provided a pull-sideways-and-open type top cabinet door prop unit according to the eleventh aspect of the invention and characterized further in that said arm spindle is linked to the rotary shaft of a damper mechanism arranged in the fitting case and designed to exert a damping effect on the closing or closing and opening motion of the cabinet door by means of viscous fluid.

According to the thirteenth aspect of the invention, there is provided a pull-up-and-store-under-the-top type cabinet door prop unit designed for the cabinet door to be pulled up to a horizontal position, pushed into the cabinet and stored under the top wall of the cabinet by means of a bracket horizontally movable along a sliding rail assembly arranged on the inner surface of one of the lateral walls of the cabinet and pivotably linked by means of a sliding hinge mechanism to the inner surface of a top portion of the cabinet door fitted into the opening of the cabinet, characterized in that it comprises a fitting case to be rigidly fitted to said bracket, a spring holder vertically movable relative to the fitting case containing it and urged downward by compression springs, a link arm pivotably linked at the upper end to the movable spring holder by means of a pivot pin, a swing arm swingable around an arm spindle located in a lower portion of the fitting case and having a base section arranged around the arm spindle and linked to the lower end of said link arm by means of a link pin and an arm section extending from the base section and an extension arm linked at the proximal end to the distal end of said swing arm by means of a joint pin so as to be adapted to become aligned with said arm section or pivotable therefrom toward the opening of the cabinet and pivotably linked at the distal end thereof by means of an anchor pin to an anchor pin bearing secured to the pull-up-and-store-under-the-top type cabinet door and that the pivot where the link arm and the base section of the swing arm are linked by means of the link pin is located closer to the cabinet door relative to the vertical axial line connecting said pivot pin and said arm spindle when the arm section and the extension arm are oblique relative to each other, whereas said pivot is moved substantially onto said vertical axial line in the initial stages of opening the cabinet door linked to the bracket by way of the sliding hinge mechanism and then further away from the cabinet door relative to said vertical axial line in the subsequent stages of opening the cabinet door until the arm section and the extension arm are aligned to expand the compression spring and complete the door opening operation.

According to the fourteenth aspect of the invention, there is provided a pull-up-and-store-under-the-top type cabinet door prop unit designed for the cabinet door to be pulled up to a horizontal position, pushed into the cabinet and stored under the top wall of the cabinet by means of a bracket horizontally movable along a sliding rail assembly arranged on the inner surface of one of the lateral walls of the cabinet and pivotably linked by means of a sliding hinge mechanism to the inner surface of a top portion of the cabinet door fitted into the opening of the cabinet, characterized in that it comprises a fitting case to be rigidly fitted to said bracket, a spring holder vertically movable relative to the fitting case containing it and urged downward by compression springs, a link arm pivotably linked at the upper end to the movable spring holder by means of a pivot pin, a swing arm swingable around an arm spindle located in a lower portion of the fitting case and having a base section arranged around the arm spindle and linked to the lower end of said link arm by means of a link pin and an arm section extending from the base section and an extension arm linked at the proximal end to the distal end of said swing arm by means of a joint pin so as to be adapted to become aligned with said arm section or pivotable therefrom toward the opening of the cabinet and pivotably linked at the distal end thereof by means of an anchor pin to an anchor pin bearing secured to the pull-up-and-store-under-the-top type cabinet door, that the pivot where the link arm and the base section of the swing arm are linked by means of the link pin is located closer to the cabinet door relative to the vertical axial line connecting said pivot pin and said arm spindle when the arm section and the extension arm are oblique relative to each other, whereas said pivot is moved substantially onto said vertical axial line in the initial stages of opening the cabinet door linked to the bracket by way of the sliding hinge mechanism and then further away from the cabinet door relative to said vertical axial line in the subsequent stages of opening the cabinet door until the arm section and the extension arm are aligned to expand the compression spring and complete the door opening operation and that said arm spindle is linked to the rotary shaft of a damper mechanism arranged in the fitting case and designed to exert a damping effect on the closing or closing and opening motion of the cabinet door by means of viscous fluid.

DETAILED DESCRIPTION OF THE PREFERRED EMBODIMENTS

Now, the present invention will be described by referring to the accompanying drawings that illustrate preferred embodiments of the invention. FIGS. 1 through 5 shows an embodiment of over-the-top type cabinet door according to either the first or the second aspect of the invention. Referring to FIGS. 1 through 5, a hinge 1*d* is fitted at an end thereof to the front edge 1*c* of the top wall 1*b* of a storage cabinet 1*a* and rigidly secured at the other end thereof to the inner rail 1*g* of a sliding rail assembly 1*f*. Thus, the door 1*e* can be swung open around the joint pin 1*h* of the hinge 1*d* by pulling up the lower end of the door 1*e* and then stored on the top wall 1*b* by pushing the door 1*e* forward to make the outer rail 1*i* of the sliding assembly slide relative to the inner rail 1*g*.

Both the first and second aspects of the invention relates to a door prop unit of an over-the-top type cabinet door D as described above that allows the cabinet door to be opened and closed very smoothly. As seen from FIGS. 1 and 5, the unit comprises a fitting case 3 to be rigidly secured to the inner surface of an upper portion of one of the lateral walls, or the lateral wall 1*j*, located close to the opening 1*k* of the cabinet 1*a* and a movable spring holder 5 contained in the fitting case 3 in such a way that it is vertically movable relative to the fitting case 3 and constantly urged downward by a number of compression springs 4 also contained in the fitting case 3.

Figure 1:
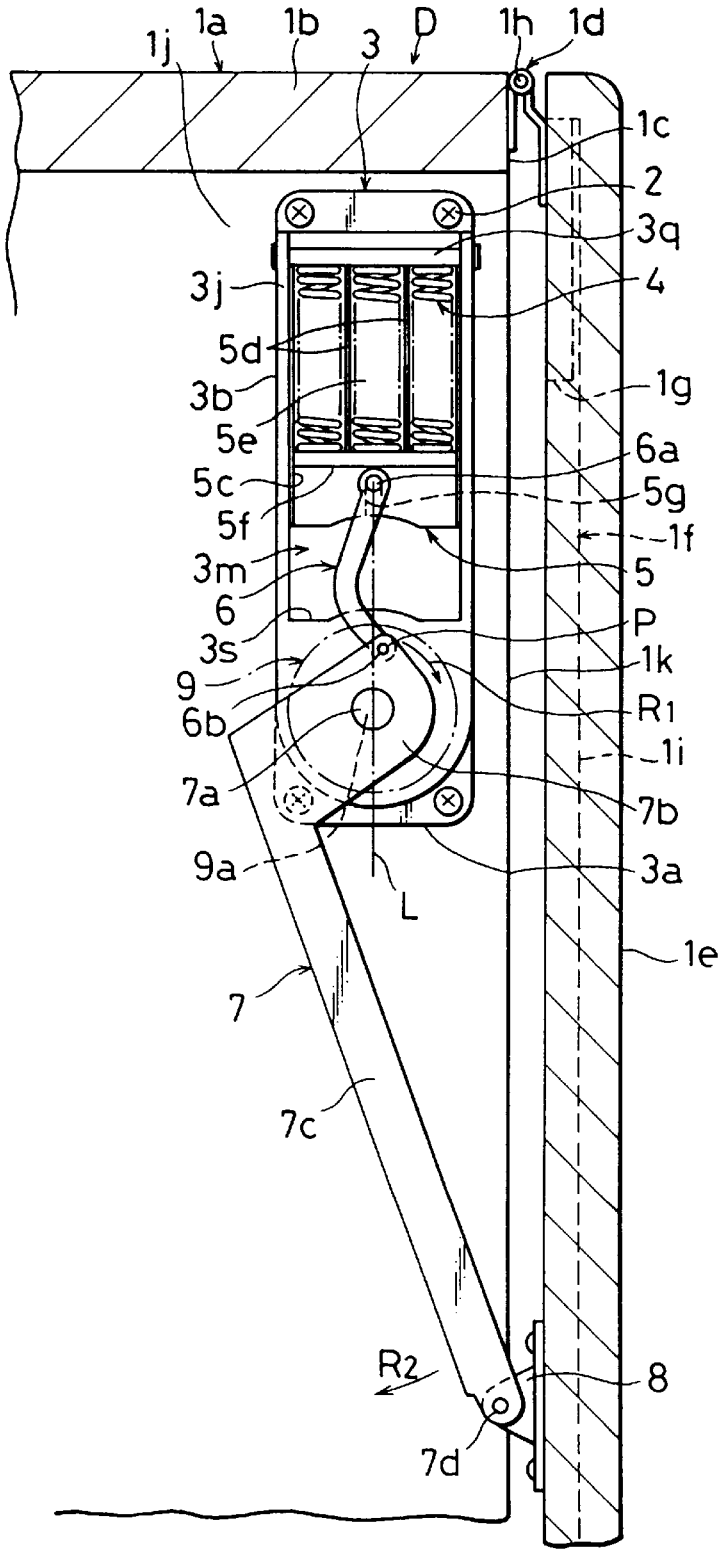
FIG. 1 is a partly cut-away schematic lateral view of an over-the-top type cabinet door prop unit according to the invention in the closed state.
Figure 5:
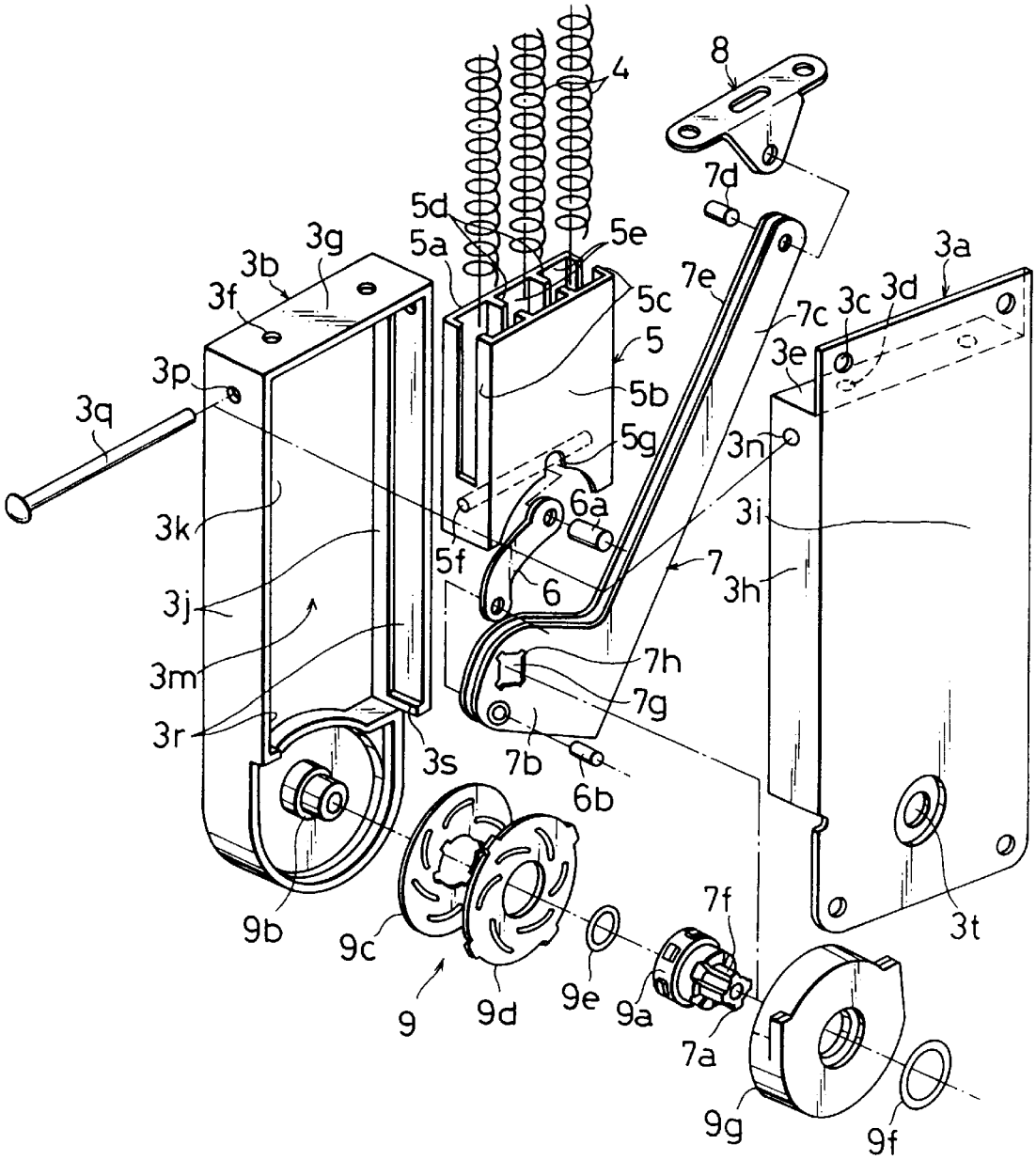
FIG. 5 is an exploded perspective view of the damper mechanism of the over-the-top type cabinet door prop unit of FIG. 1.

The fitting case 3 shown in FIG. 5 includes a reinforcing cover plate 3*a* to be fitted to the inner surface of the lateral wall 1*j* and a fitting case main body 3*b* fitted into the cover plate 3*a*, of which the reinforcing cover plate 3*a* is provided with fitting holes 3*c* for allowing respective screws 2 to pass therethrough as shown in FIG. 1 and through holes 3*d* bored through the top wall section 3*e* of the reinforcing cover plate 3*a*, while the fitting case main body 3*b* is provided with threaded holes 3*f* bored through an end of the top wall section 3*g* of the fitting case main body 3*b* so that the fitting case 3 may be assembled by placing the fitting case main body 3*b* into the reinforcing cover plate 3*a* and binding them together by means of screws that are driven into the through holes 3*d* and the threaded holes 3*f* respectively.

Referring further to FIG. 5, the reinforcing cover plate 3*a* has lateral wall sections 3*h* extending downward from the opposite ends of the top wall section 3*e* along the fitting rear wall section 3*i*, whereas the fitting case main body 3*b* has its own lateral wall sections 3*j* also extending downward from the opposite ends of the wall section 3*g* along the fitting front wall section 3*k*. Thus, a closed space 3*m* is defined within the fitting case main body to vertically movably contain the movable spring holder 5 therein.

The lateral wall sections 3*h* of the reinforcing cover plate 3*a* are provided with respective through holes 3*n*, whereas the lateral wall sections 3*j* of the fitting case main body 3*b* are provided with respective through holes 3*p* to allow a spring anchoring rod 3*q* to pass therethrough and be rigidly held there, against which compression springs 4*a* pressed at the upper ends thereof.

The movable spring holder 5 will be described in greater detail by referring to FIG. 5. It comprises a front wall 5*a*, a rear wall 5*b* and lateral walls 5*c* to define a box-shaped profile having a top opening and is also provided with a pair of internal partition walls 5*d* to define three oblong rectangularly parallelepipedic spaces 5*e* for allowing respective compression springs to pass therethrough along with the paired lateral walls 5*c*. The three compression 4 contained in the respective spaces are pressed against the spring anchoring rod 3*q* at the top thereof and against a spring receiving rod 5*f* secured horizontally to the lateral walls 5*c* of the movable spring holder 5.

Thus, the movable spring holder 5 is housed in the closed space 3*m* and vertically movable within it either upwardly to compress the compression springs 4 or downwardly to expand the compression springs 4 as its lateral walls 5*c* slide along the respective inner surfaces of the corresponding lateral walls sections 3*j* of the fitting case 3.

Referring further to FIG. 5 for the third and fourth aspects of the invention, it also shows a guide groove 3*r* on the inner surface of each of the lateral wall sections 3*j* that is engaged with the corresponding lateral wall 5*c* of the movable spring holder 5 to make the latter move smoothly in the vertical direction so that the movable spring holder 5 eventually abuts a stopper member 3*s* arranged at the lower end of the guide groove 3*r* as it moves downward and the downward movement of the movable spring holder 5 is blocked there. Under this condition, the resilient force of the compression springs 4 is not transmitted to the downstream members any more.

Then, a link arm 6 is arranged in a lower portion of the fitting case 3 and pivotably linked at the upper end thereof to the movable spring holder 5 by means of a pivot pin 6*a* and at the lower end thereof to the base section 7*b* of a swing arm 7 formed around an arm spindle 7*a* by means of a link pin 6*b*. An arm section 7*c* of the swing arm 7 is extending from the base section 7*b* and the distal end of the arm section 7*c* is pivotably linked by way of an anchor pin 7*d* to an anchor pin bearing 8 that is rigidly secured to the door 1*e*.

Referring to FIG. 5 for the third and fourth aspects of the invention, the front wall 5*a* and the rear wall 5*b* of the movable spring holder 5 are provided at respective lower central areas thereof with respective vertical slots 5*g* for movably holding the pivot pin 6*a* for the link arm 6 in stead of holes for receiving the pivot pin 6*a*, the vertical slots 5*b* being open at the respective lower ends. The swing arm 7 is provided with a gap 7*e* running vertically at the middle of the width so that the lower end of the link arm 6 is inserted into the gap 7*e* and pivotably linked to the base section 7*b* of the swing arm 7 by means of a link pin 6*b* without altering the relationship of the arm section 7*c*, the anchor pin bearing 8 and the anchor pin 7*d*.

In FIG. 5, the relationship between the swing arm 7 and the arm spindle 7*a* is such that engaging projections 7*f* of the arm spindle 7*a* are engaged respectively with corresponding engaging recesses 7*h* of the spindle hole 7*g* formed through the base section 7*b* of the swing arm 7 in order to transmit the rotary motion of the swing arm 7 to the arm spindle 7*a*. For the second and fourth aspects of the invention, the arm spindle 7*a* is coaxially linked to the rotary shaft 9*a* of the damper mechanism 9 arranged in a lower portion of the fitting case 3.

Thus, referring to FIG. 5, as the swing arm 7 is swung, the closing or opening motion of the cabinet door 1*e* is damped by the damping effect of the viscous fluid contained in the damper mechanism 9 as will be described in greater detail hereinafter. The damper mechanism 9 itself illustrated in FIG. 5 is known and comprises a damper bearing section 9b arranged in a lower portion of the fitting case main body 3*b*, a movable disc 9*c* fitted to the rotary shaft 9*a*, a stationary disc 9*d* arranged adjacent to the movable disc 9*c* and blocked against any rotary motion, a pair of O-rings 9*e* and 9*f* and a lid 9*g* secured to the reinforcing cover plate 3*a* by means of a screw (not shown) driven into it through a screw bore 3*t*. What is important with the damper mechanism 9 having a configuration as described above is the selection of the pivotal point P at which the lower end of the link arm 6 is linked to the base section 7*b* of the swing arm 7 by means of a link pin 6*b*.

Figure 2:
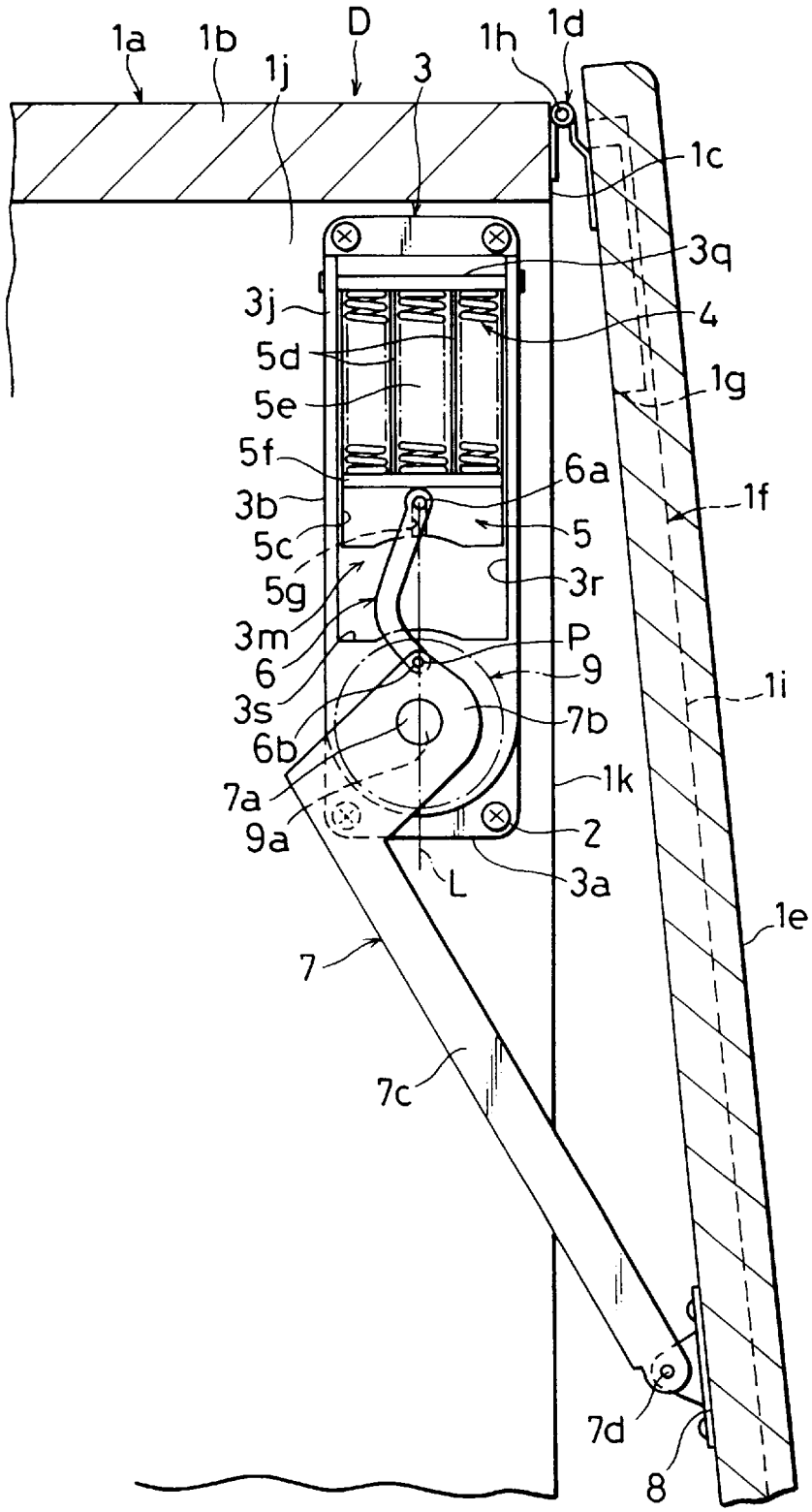
FIG. 2 is a partly cut-away schematic lateral view of the over-the-top type cabinet door prop unit of FIG. 1 in a initial stage of the door opening motion.
Figure 3:
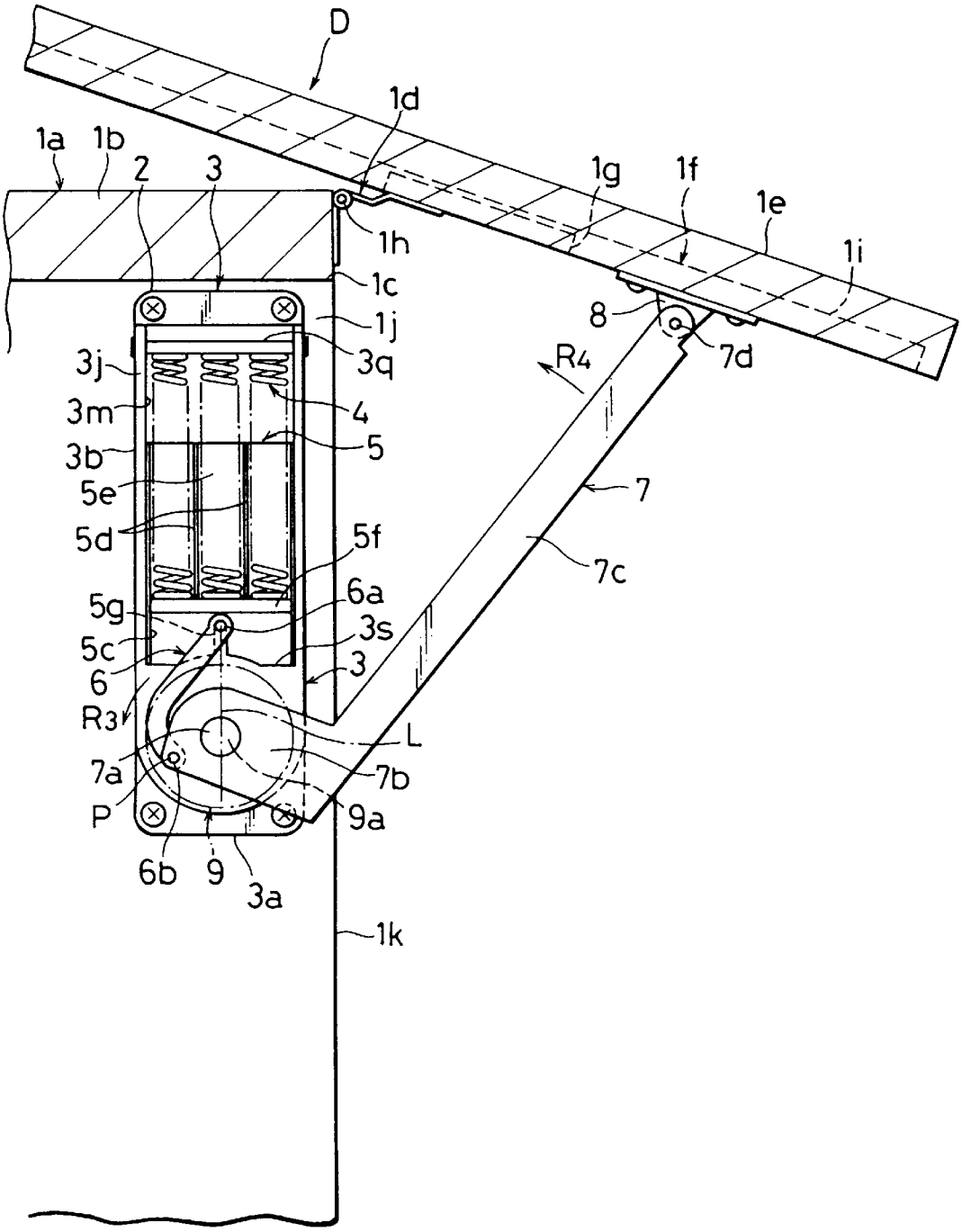
FIG. 3 is a partly cut-away schematic lateral view of the over-the-top type cabinet door prop unit of FIG. 1 in a subsequent stage of the door opening motion.
Figure 4:
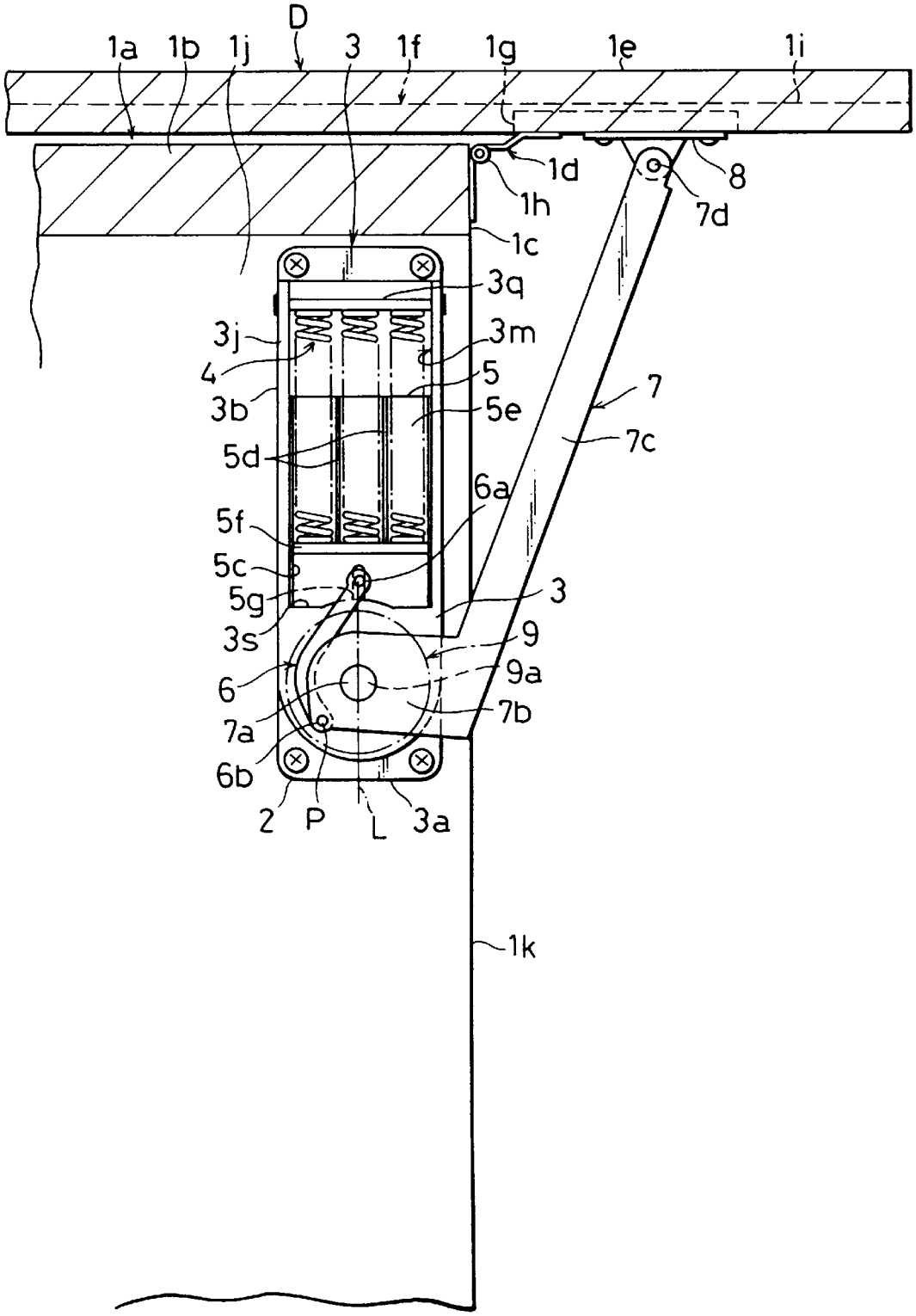
FIG. 4 is a partly cut-away schematic lateral view of the over-the-top type cabinet door prop unit of FIG. 3 in the final stage of the door opening motion.

For the first and second aspects of the invention, the pivotal point P is located closer to the door 1*e* relative to the vertical axial line L connecting the pivot pin 6*a* and the arm spindle 7*a* when the cabinet door is closed as shown in FIG. 1. As seen from FIG. 1, the compression springs 4 are in a compressed state under this condition in an over-the-top type door prop unit according to the first aspect of the invention so that a downwardly directed force is applied to the link arm 6 under the resilient effect of the compression spring 4. Thus, the base section 7*b* of the swing arm 7 is subjected to a rotary force in the direction of arrow R1 at the pivotal point P and, consequently, the arm section 7*c* is forced to rotate in the direction of arrow R2 so that the door 1*e* is held to the closed position and would not be inadvertently opened. Then, as the door 1*e* is turned upward and opened by hand from the closed state shown in FIG. 1, holding the lower end of the door 1*e*, the pivotal point P is turned counterclockwise until it is located on the vertical axial line L as shown in FIG. 2 to provide a change point there in the initial stages of the door opening motion. As the door is further opened, it comes into the subsequent stages as shown in FIG. 3, where the pivotal point P is turned away from the door 1*e* relative to the vertical axial line L so that the resilient force of the compression springs 4 urges the base section 7*b* to rotate in the direction of arrow R3 that is opposite to the direction of arrow R1 and the swing arm 7 is turned along the direction of arrow R4 to further open the door. Therefore, the user can open the door 1*e* until it is stored on the top wall 1*b* with little effort by utilizing the resilient force of the compression springs 4. For closing the door 1*e* stored on the top wall 1*b*, the user only has to pull down the door 1*e* for the initial stages of the closing motion. Thereafter, the door 1*e* moves down by itself due to its own weight if the user releases the door. Note that, under this condition, the door 1*e* is closed very slowly until it gets to the completely closed position of FIG. 1 under the buffering effect of the compression springs 4 because the compression springs 4 are gradually compressed from their expanded state to exert their resilient force. Once the door 1*e* is completely closed, it is held to that state as described above. An over-the-top type cabinet door prop unit according to the second aspect of the invention is realized by adding a damper mechanism 9 to a door prop unit according to the first aspect of the invention. If the damper mechanism 9 is arranged in such a way that its damping effect is exerted by means of a one-way clutch (not shown) only when the door is being closed, then the door closing motion can be made more slowly and smoothly than that of the door according to the first aspect of the invention.

The damper mechanism may alternatively be so arranged that its damping effect can be utilized for both the closing motion and the door opening motion. If such is the case, while the resilient force of the compression springs 4 for increasing the door closing effect is reduced by the damping effect of the damper mechanism when the door is opened, this disadvantage can be minimized by maximizing the resilient force to be used for increasing the door closing effect. It may be needless to say that the use of a one-way clutch is not necessary in this case.

With a over-the-top type cabinet door prop unit according to the third aspect of the invention, it gets into the initial stages of the door opening motion from the closed state shown in FIG. 1 when it passes the change point of FIG. 2 as in the case of its counterpart according to the first aspect of the invention. Under this condition, the pivotal point P is moved away from the door relative to the vertical axial point L to allow the resilient force of the compression springs 4 to accelerate the door opening motion until the door prop unit gets into the subsequent stages of the door opening motion shown in FIG. 3. However, the door prop unit according to the third aspect of the invention differs from its counterpart described above for the first aspect of the invention in that, once it gets into the subsequent stages of the door opening motion, the movable spring holder 5 that has been pushed down by the compression springs 4 abuts the stopper members 3*s* in the guide grooves 3*r* to make the resilient force of the compression springs 4 ineffective for rotating the swing arm 7.

As a result, the door prop unit 1*e* is totally free now so that it can easily be pushed onto the top wall 1*b* of the cabinet door from the position shown in FIG. 3. Now, the movable spring holder 5 of the cabinet door prop unit according to the third aspect of the invention is provided with vertical slots 5*g* and, while the pivot pin 6*a* is located at the top of the vertical slots 5*g* in FIG. 3, it moves down along the vertical slots 5*g* as the door is opened by hand so that the user can push the door 1*e* onto the top wall 1*b* until it is squarely placed on the top wall 1*b* as the outer rail 1*i* is slidingly moved relative to the inner rail 1*g*.

A door prop unit according to the fourth aspect of the invention is realized by adding a damper mechanism 9 to a door prop unit according to the third aspect of the invention and, therefore, its effects are substantially same as those described above by referring to the second aspect of the invention.

Now, a pull-down-and-open type cabinet door prop unit according to the fifth aspect of the invention will be described by referring to FIGS. 6A and 6B. With the pull-down-and-open type door D1, the door proper 1*e* is swingably fitted to the front edge 1*n* of the bottom wall 1*m* of the cabinet main body 1*a* to close the opening 1*k* by means of a hinge 1*d*. Thus, the door 1*e* can be turned from its upright closed position shown in FIG. 6A to the opened position as shown in FIG. 6B, where the door 1*e* of the pull-down-and-open door D1 is substantially flush with the bottom wall 1*m* of the cabinet main body 1*a*.

Figure 6A:
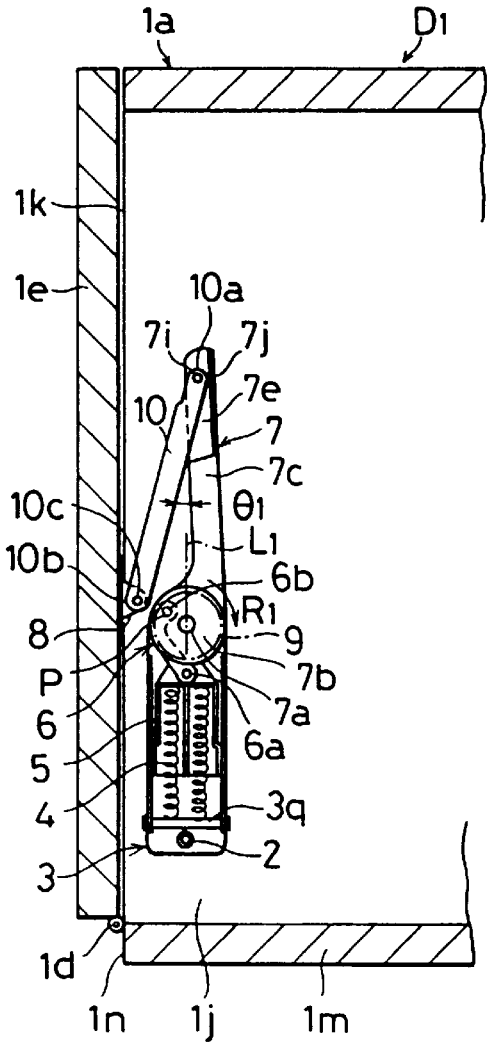
FIGS. 6A and 6B are partly cut-away schematic lateral views of an over-the-top type cabinet door prop unit according to the fifth or sixth aspect of the invention in the closed state and in the open state respectively.
Figure 6B:
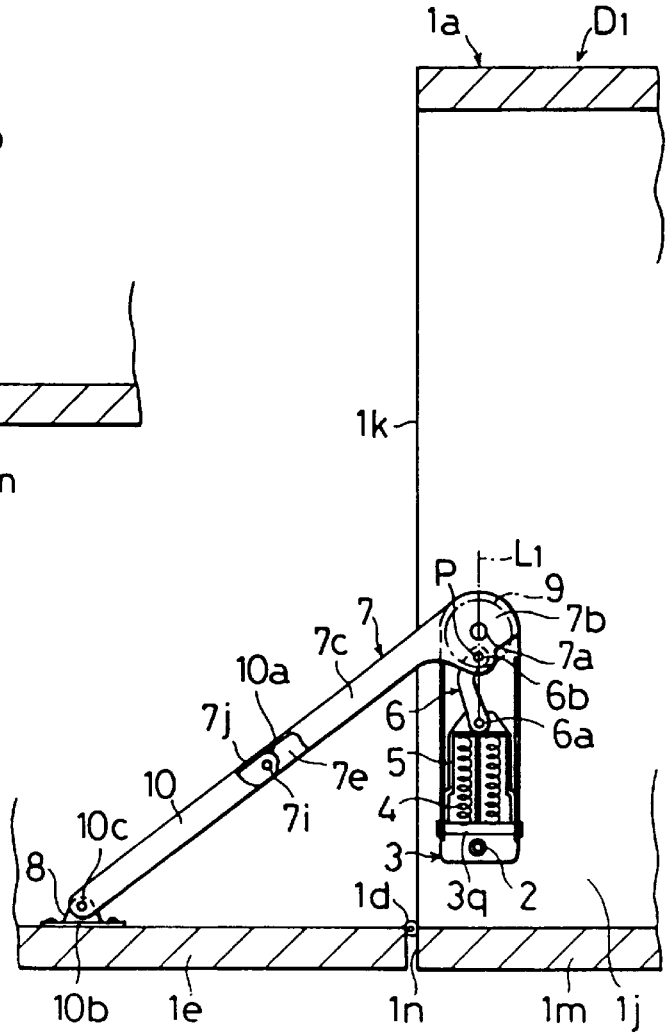
Figure 7:
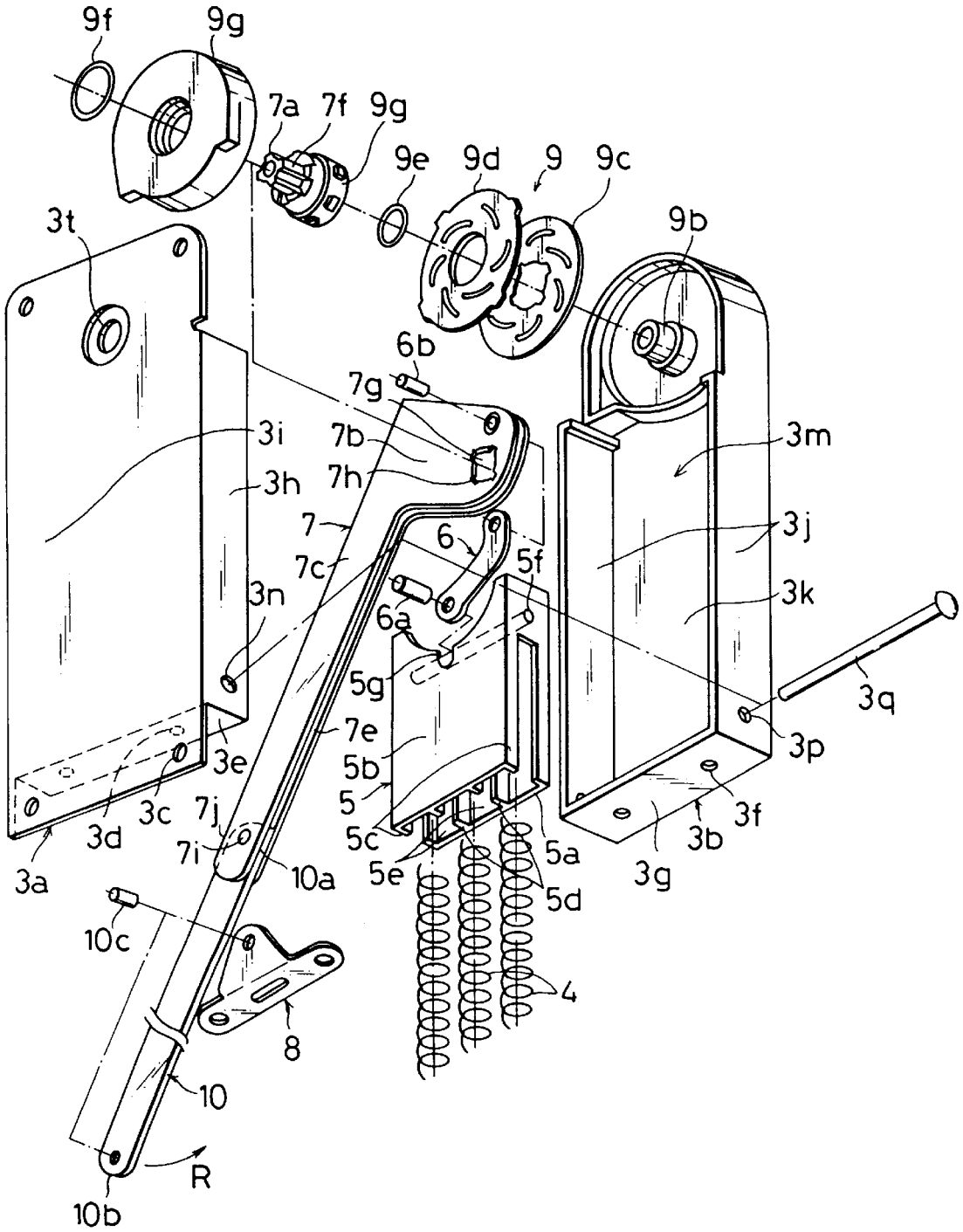
FIG. 7 is an exploded perspective view of the damper mechanism of a cabinet door prop unit according to any of the fifth through fourteenth aspects of the invention.

Thus, as shown in FIGS. 6A, 6B and 7, the pull-down-and-open type cabinet door prop unit of the fifth aspect of the invention comprises a fitting case 3 rigidly secured to a lower portion of the inner surface of one of the lateral walls 1*j* of the door main body 1*a* at a position close to the opening 1*k* by means of screws 2 and a fitting case 3 housed in the fitting case 3 in such a way that it is vertically movable relative to the fitting case 3 and urged upward by means compression springs 4.

As seen from FIG. 7, the fitting case 3 has a configuration substantially similar to that of its counterpart of FIG. 5. Therefore, the components similar to those of FIG. 5 are denoted respectively by the same reference symbols. However, the fitting case 3 of FIG. 7 differs from that of FIG. 5 in that it does not have guide grooves 3*r* and stopper members 3*s* shown in FIG. 5 but has additional components as described below. Namely, in addition to the fact that the link arm 6 is linked at the top thereof to the base section 7*b* of the swing arm 7 as shown in FIG. 5, the arm section 7*c* of the swing arm 7 extending from the base section 7*b* is connected at the distal end thereof to the proximal end 10*a* of an extension arm 10 by means of a point pin 7*i*. In the fully opened position, the extension arm 10 is aligned with the arm section 7*c* of the swing arm 7. For this, the proximal end 10*a* of the extension arm 10 is inserted into the gap 7*e* formed in the arm section 7*c* such that the extension arm 10 is held aligned with the arm section 7*c* and prevented from turning further as the extension arm 10 abuts the folded edge 7*j* f the arm section 7*c* but can be turned back in the opposite direction indicated by arrow R in FIG. 7 until it is partly received in the gap 7*e*. The distal end 10*b* of the extension arm 10 is pivotably linked to the anchor pin bearing 8 by means of an anchor pin 10*c*, said anchor pin bearing 8 being rigidly secured to the inner surface of the door proper 1*e* of the door proper 1*e* of the pull-down-and-open type door D1 by means of screws. The pull-down-and-open type door having the above described configuration operates as in a manner as described below by referring to FIGS. 6A and 6B. When the door is closed as shown in FIG. 6A, the arm section 7*c* of the swing arm 7 and the link arm 6 are held aslant to expand the compression springs 4 as they are bent relative to each other at the pivot point P linking the link arm 6 and the base section 7*b* of the swing arm 7. Under this condition, the pivot point P is located closer to the door relative to the vertical axial line L1 connecting the pivot pin 6*a* and the arm spindle 7*a*.

More specifically, the compression springs 4 urge the movable spring holder 5 upward in the fitting case 3 and the extension arm 10 has been turned at the joint pin 7*i* toward the lateral side of the arm section 7*c* that is closer to the door 1*e*, while the link pin 6*b* is located closer to the door relative to the vertical axial line L1 so that consequently the base section 7*b* of the swing arm 7 is urged to rotate in the direction of arrow R1 by the resilient force of the compression springs 4 and hence the door 1*e* is constantly pulled toward the opening 1*k* by the extension arm 10 to maintain the door 1*e* in the closed state.

When the closed door 1*e* is pulled down by holding the upper end thereof by hand to make it rotate round the hind 1*d*, the extension arm 10 is also pulled with the door by way of the anchor pin bearing 8 to increase the angle θ1 between the arm section 7*c* and the anchor pin bearing 8 so that the link arm 6 lowers the movable spring holder 5 to compress and increase the resilient force of the compression springs 4 for pushing the door 1*e* open. As a result, the door 1*e* rotates downward to its fully open position as shown in FIG. 6B while being subjected to a damping effect of the unit.

When the door is fully opened and the angle θ1 between the arm section 7*c* and the anchor pin bearing 8 gets to its maximum value of 180 degrees, the extension arm 10 abuts the folded edge 7*j* of the arm section 7*c* to maintain the aligned condition of the arm section 7*c* and the extension arm 10, where the door 1*e* is flush with the bottom wall 1*m* of the cabinet 1*a*. Note that it is so arranged that the pivot point P turns downward substantially onto the vertical axial line L1 under this condition. Thus, when the door is fully opened, the compression springs 4 are sufficiently compressed but the resilient force of the compression springs 4 is not transmitted to the base section 7*b* way of the link pin 6*b* so that the door 1*e* is safe in its fully open position as it is not subjected to any excessive force.

A pull-down-and-open type cabinet door prop unit according to the sixth aspect of the invention is realized by linking the rotary shaft 9*a* of a damper mechanism 10 designed to dampen the opening motion or the opening and closing motion of the door 1*e* by means of viscous fluid to a door prop unit according to the fifth aspect of the invention. Note that, if the damper mechanism 10 is made available only for the door opening motion by means of a one-way clutch (not shown), the door opening motion of the door using this door prop unit will become further slow and smooth when compared with the above described door prop unit of the fifth aspect of the invention.

Figure 8A:
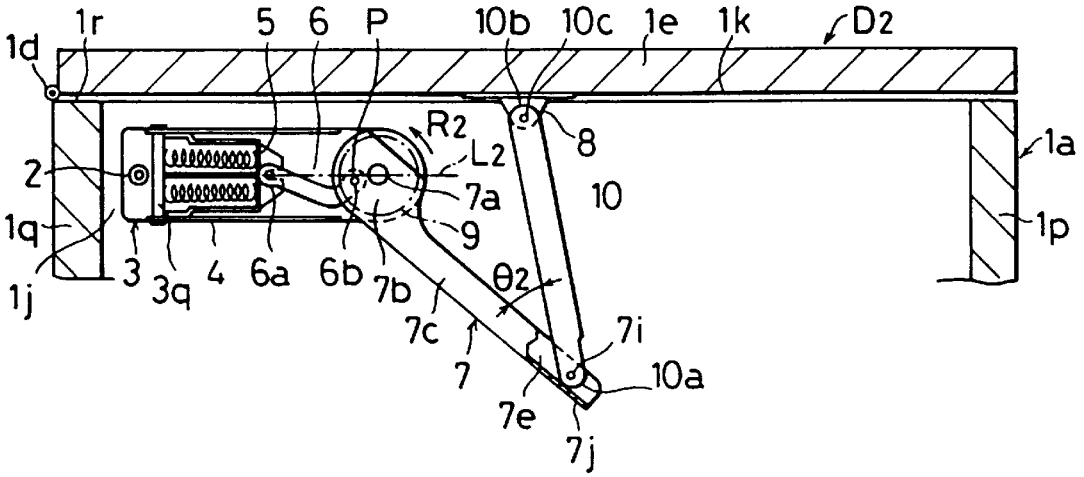
FIGS. 8A and 8B are partly cut-away schematic lateral views of an pull-up-and-open type top cabinet door prop unit according to the seventh or eighth aspect of the invention in the closed state and in the open state respectively.
Figure 8B:
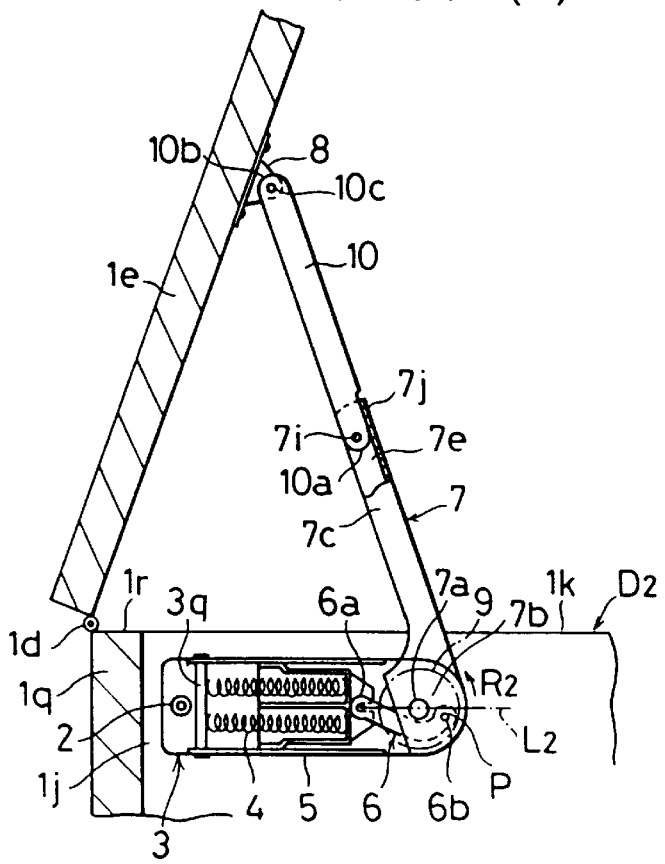

Now, a pull-up-and-open type top door prop unit according to the seventh aspect of the invention will be described. FIGS. 8A and 8B illustrate a pull-up-and-open type top door D2 under consideration. There is also shown a cabinet 1*a* comprising an opening 1*k* facing upward, a front wall 1*p*, a rear wall 1*q*, a pair of lateral walls and a bottom wall. The door proper 1*e* is swingably secured to the upper edge of the rear wall 1*q* by means of a hinge 1*d*. The illustrated embodiment of door prop unit is essentially identical with the one described above in terms of the fifth aspect of the invention and by referring to FIGS. 6A and 6B, although the fitting case 3 is arranged horizontally and fitted to the inner surface 1*j* of one of the lateral walls at a position close to the corner defined by the opening 1*k* and the rear wall 1*q* by means of screws 2. In this case again, the distal end 10*b* of the extension arm 10 is pivotably fitted by means of an anchor pin 10*c* to the anchor pin bearing 8 arranged on the lower surface of the door 1*e*. Thus, the movable spring holder 5 is horizontally movable and urged toward the front wall 1*p* by the compression springs 4. It is pivotably linked to the link arm 6 by means of a pivot pin 6*a* at a position relatively close to the real wall 1*q*, which link arm 6 is by turn pivotably linked to the base section 7*b* of the swing arm 7 by means of a link pin 6*b*. The link pin 6*b* and the arm spindle 7*a* of the swing arm 7 are located relatively close to the front wall 1*p*. This arrangement according to the seventh aspect of the invention differs from that of the fifth aspect of the invention in that, when the pull-up-and-open type cabinet door D2 is closed and hence the arm section 7*c* and the extension arm 10 are oblique relative to each other to compress the compression springs 4 as shown in FIG. 6A, the pivot point P of the link arm 6 and the base section 7*b* of the swing arm 7 of the former arrangement is located between the pivot pin 6*a* and the arm spindle 7*a* and slightly away from the door 1*e* relative to the horizontal axial line L2 connecting the pivot pin 6*a* and the arm spindle 7*a*. Thus, as long as the door is closed, the link arm 6 is urged toward the front wall 1*p* by the strong resilient force of the compression springs 4 to exert a relatively small rotary force onto the base section 7*b* in the direction of arrow R2 so that the upper edges of cabinet surrounding the opening 1*k* does not have to bear the entire weight of the door 1*e*. In other words, the door held closed while the weight of the door 1*e* less the rotary force is applied to the upper edges of the cabinet surrounding the opening 1*k*. Then, as the front edge of the door 1*e* is turned upward by hand to open the door 1*e*, the angle θ2 between the arm section 7*c* and the anchor pin bearing 8 is increased and the link arm 6 pushes the movable spring holder 5 toward the front wall 1*p* to expand the compression springs 4 so that consequently the door 1*e* can be opened with little effort due to the resilient force of the compression springs 4. When the door is fully opened and the angle θ1 gets to its maximum value of 180 degrees as shown in FIG. 8B, the extension arm 10 and the arm section 7*c* are held to an aligned state and the door 1*e* is standing almost upright. Note that, with the above described embodiment of door prop unit, the link pin 6*b* is positionally so arranged relative to the base section 7*b* that the compression springs 4 is expanded to move the pivot point P closer to the front wall 1*p* than the arm spindle 7*a* and away from the door relative to the horizontal axial line L2 as the movable spring holder 5 is moved sideways toward the front wall 1*p* of the cabinet.

Thus, the resilient force of the compression springs 4 is exerted onto the swing arm 7 in the direction of arrow R2 to securely maintain the door in the fully opened state.

When the door 1*e* is turned downward from the fully opened state to make the arm section 7*c* and the extension arm 10 become oblique relative to each other, the load of the moving door is applied to the swing arm 7 to rotate it in the direction opposite to that indicated by arrow R2 as the load increases with the closing motion of the door 1*e* and the compression springs 4 are compressed as the movable spring holder 5 is moved sideways toward the rear wall 1*q* so that consequently the door 1*e* slowly and gradually moves downward to its fully closed state under the braking effect of the compression springs 4.

As in the case of the fifth and sixth aspects of the invention, a pull-down-and-open type top door prop unit according to the eighth aspect of the invention is realized by linking the rotary shaft 9*a* of a damper mechanism 10 designed to dampen the opening motion or the opening and closing motion of the door 1*e* by means of viscous fluid to a door prop unit according to the seventh aspect of the invention. Note that, if the damper mechanism 10 is made available only for the door opening motion by means of a one-way clutch (not shown), the door opening motion of the door using this door prop unit will become further slow and smooth when compared with the above described door prop unit of the seventh aspect of the invention. Additionally, the damping effect of the damper mechanism 10 may be exploited for both opening and closing the door. If such is the case, while the resilient force of the compression springs 4 for increasing the door closing effect is reduced by the damping effect of the damper mechanism when the door is opened, this disadvantage can be minimized by maximizing the resilient force to be used for increasing the door closing effect.

Figure 9:
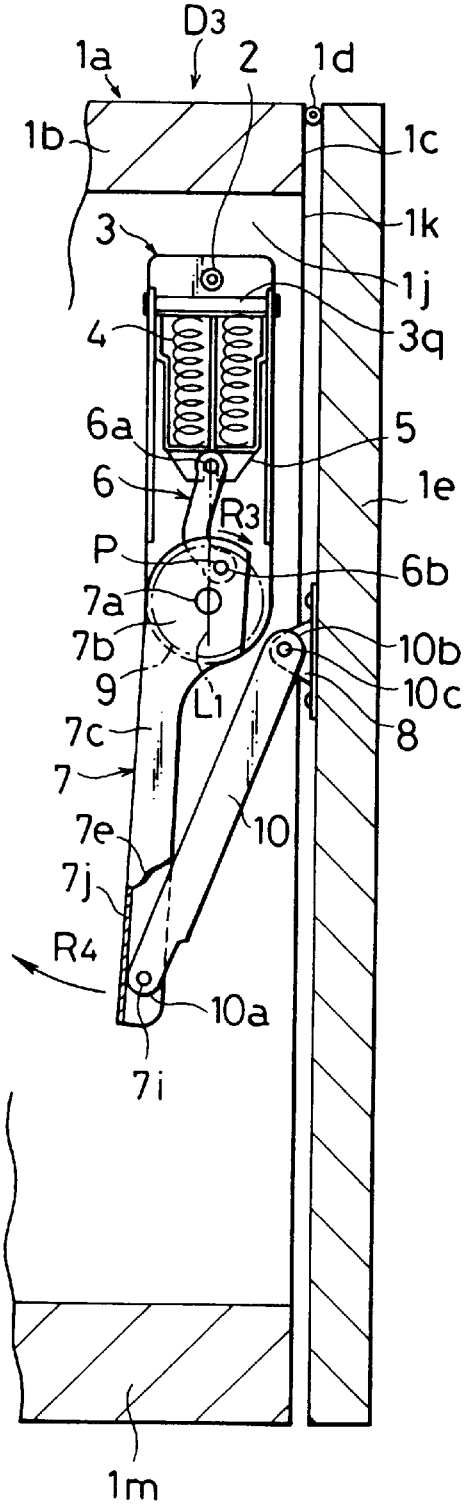
FIG. 9 is a partly cut-away schematic lateral view of an pull-up-and-open type cabinet door prop unit according to the seventh or eighth aspect of the invention in the closed state.
Figure 10:
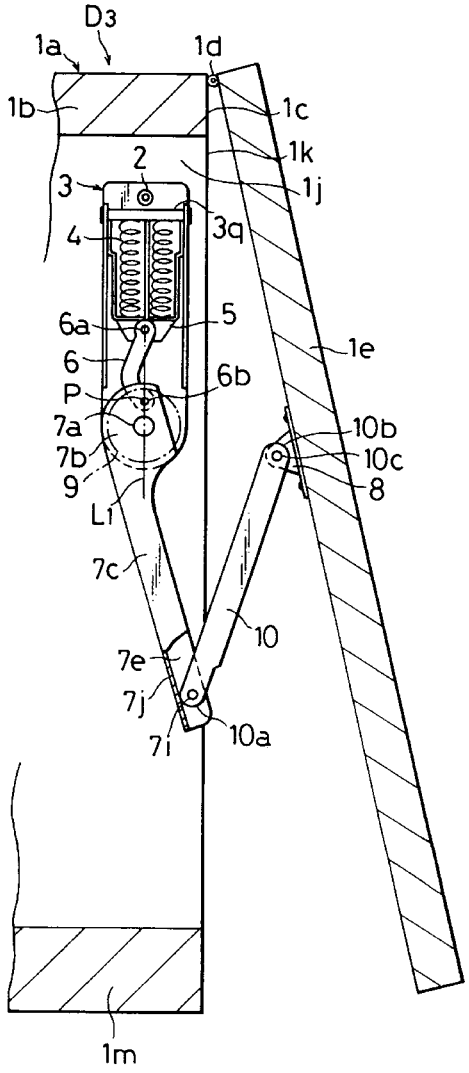
FIG. 10 is a partly cut-away schematic lateral view of the pull-up-and-open type cabinet door prop unit of FIG. 9 in a initial stage of the door opening motion.
Figure 11:
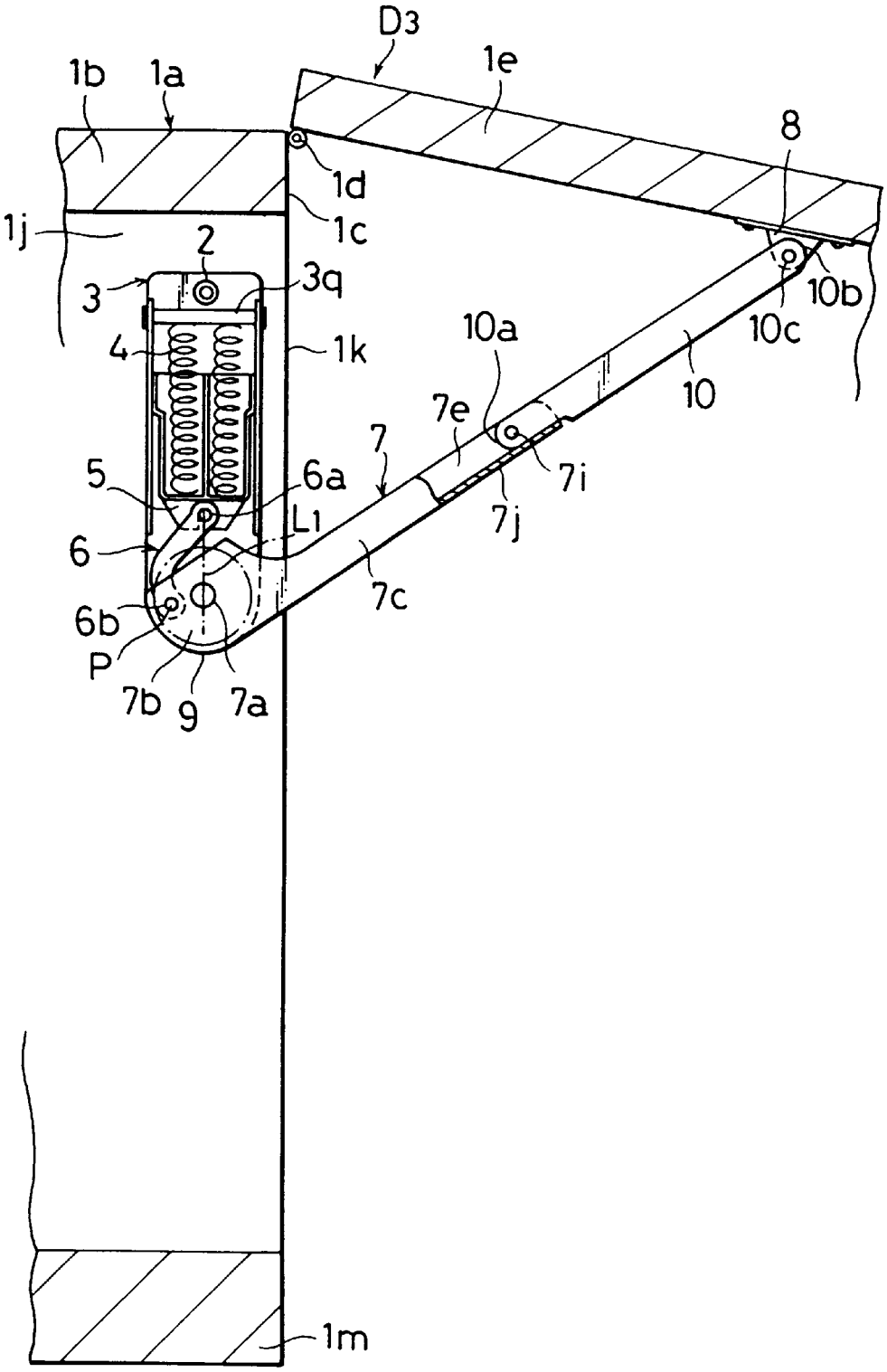
FIG. 11 is a partly cut-away schematic lateral view of the pull-up-and-open type cabinet door prop unit of FIG. 9 in the final stage of the door opening motion.

Now, a pull-up-and-open type door prop unit according to the ninth aspect of the invention will be described. FIGS. 9 through 11 illustrate a pull-up-and-open type door D3 under consideration. There is shown a cabinet 1*a* comprising an opening 1*k* facing forward and a top wall 1*b*. The door proper 1*e* is swingably secured to the upper edge of the top wall 1*b* by means of a hinge 1*d*.

The illustrated embodiment of door prop unit is essentially identical with the one described above in terms of the fifth aspect of the invention and by referring to FIGS. 6A and 6B, although the fitting case 3 is arranged upside down and fitted to the inner surface 1*j* of one of the lateral walls in an upper portion thereof close to the opening 1*k*. Thus, the movable spring holder 5 is vertically movable as it is urged by the compression springs 4 and the link arm 6 is pivotably linked at the upper end thereof to the movable spring holder 5 by means of a pivot pin 6*a* and at the lower end thereof to the base section 7*b* of the swing arm 7 by means of a link pin 6*b*, said base section 7*b* being rotatable around an arm spindle 7*a*.

As described above for the preceding aspects of the invention, an extension arm 10 is linked at the proximal end thereof to the arm section 7*c* of the swing arm 7 by means of a joint pin 7*i* and at the distal end thereof to the anchor pin bearing 8 rigidly secured to the door 1*e* by means of an anchor pin 10*c*. When the door is closed and the arm section 7*c* and the extension arm 10 are oblique relative to each other to compress the compression springs 4 as shown in FIG. 9, the pivot point P of the link arm 6 and the base section 7*b* of the swing arm 7 is located closer to the door relative to the vertical axial line L1.

Thus, when the door is closed, the base section 7*b* is urged to rotate in the direction of arrow R3 by the link arm 6 under the effect of the resilient force of the compression springs 4 and consequently the arm section 7*c* is urged to rotate in the direction of arrow R4 so that the door 1*e* is held to the closed state.

Now, if the door 1*e* is pulled upward to open by the user who is holding the lower end of the door, the pivot point P is moved onto the vertical axial line L1 in the initial stages of the door opening motion as shown in FIG. 10 to provide a change point for the door prop unit, where no rotary force is applied to the door 1*e* both in the door opening motion and in the door opening motion. After passing by the change point, the door opening motion gets into the subsequent stages until the door becomes fully opened, when the arm section 7*c* and the extension arm 10 are aligned to expand the compression springs 4 and the pivot point P is located away from the door relative to the vertical axial line L1 as shown in FIG. 11 to transmit a rotary force trying to open the door to the door so that the door is held to its opened position.

The door can be moved from the fully opened position toward the closed position simply by releasing the arm section 7*c* and the extension arm 10 from the aligned state. Then, the door 1*e* is closed by its own weight, although the swing arm 7 is swung reversely to push up the movable spring holder 5 by way of the link arm 6 and compress the compression springs 4 so that consequently the door 1*e* is closed very slowly and, once it get to the completely closed position, it maintains the closed state.

A pull-up-and-open type door prop unit according to the tenth aspect of the invention is realized by adding a damper mechanism 9 to a door prop unit according to the ninth aspect of the invention and, therefore, its effects are substantially same as those described above by referring to the sixth and eighth aspects of the invention.

Figure 12:
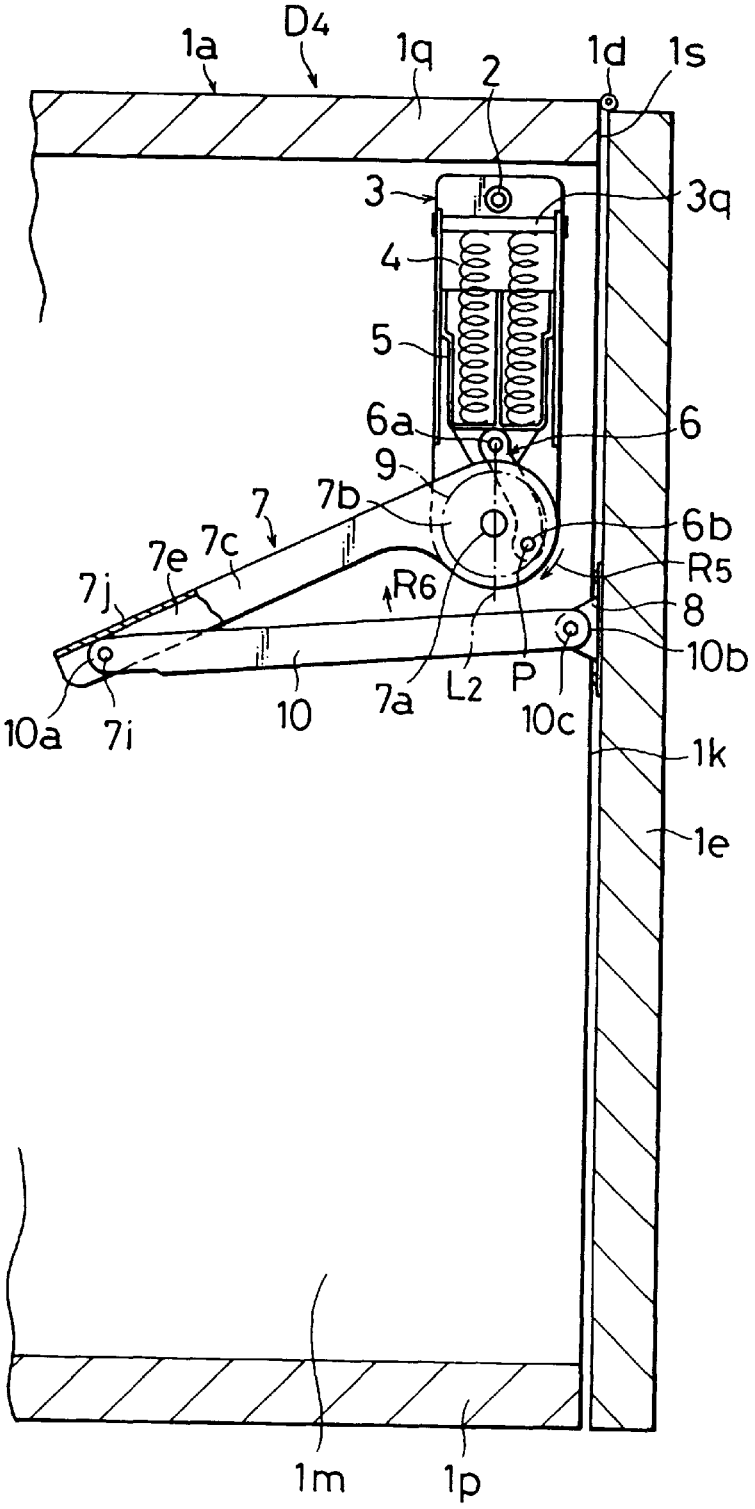
FIG. 12 is a partly cut-away schematic lateral view of an pull-sideways-and-open type cabinet door prop unit according to the seventh or eighth aspect of the invention in the closed state.
Figure 13:
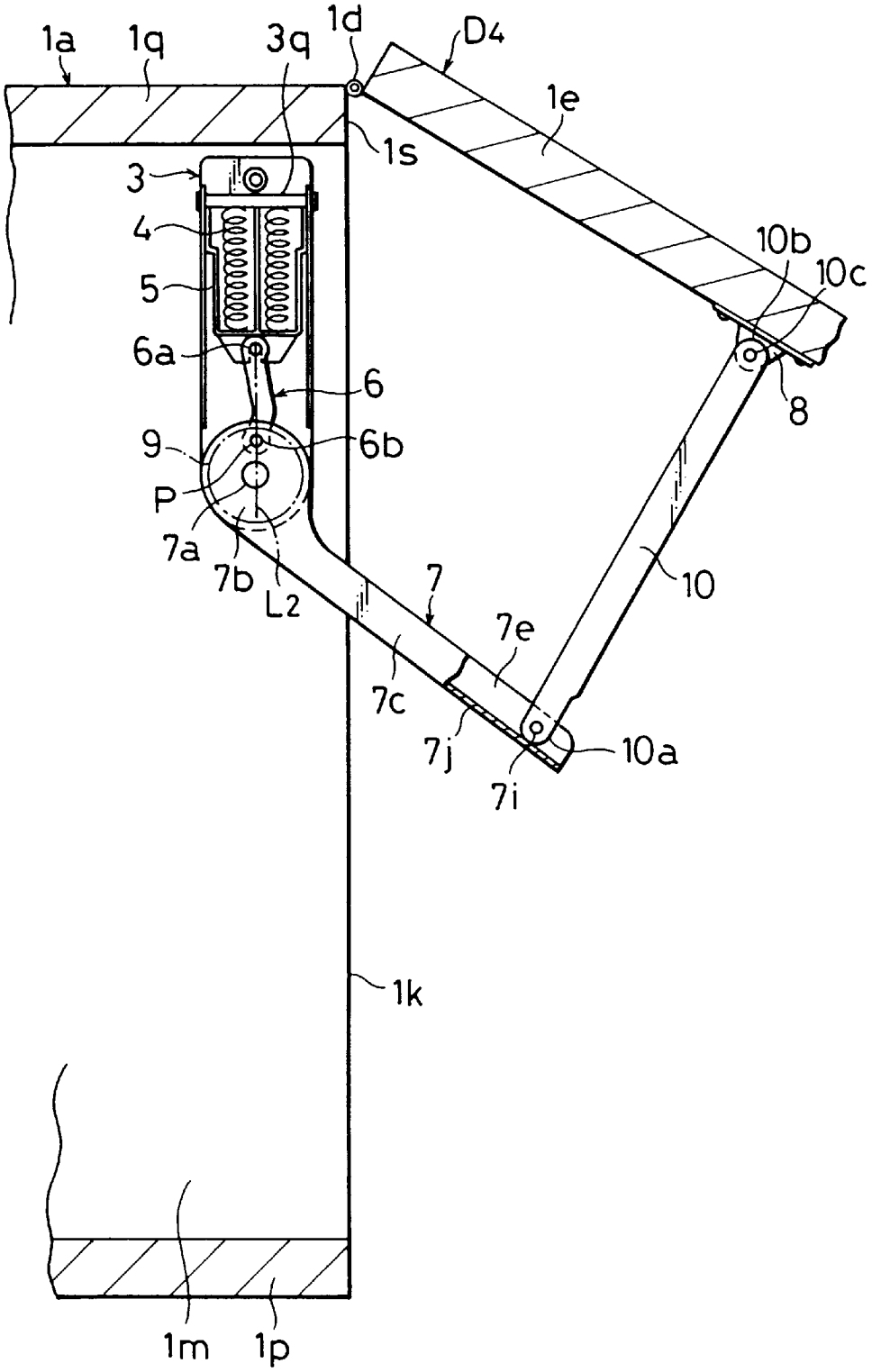
FIG. 13 is a partly cut-away schematic lateral view of an pull-sideways-and-open type cabinet door prop unit of FIG. 12 in a state where the door is being opened.
Figure 14:
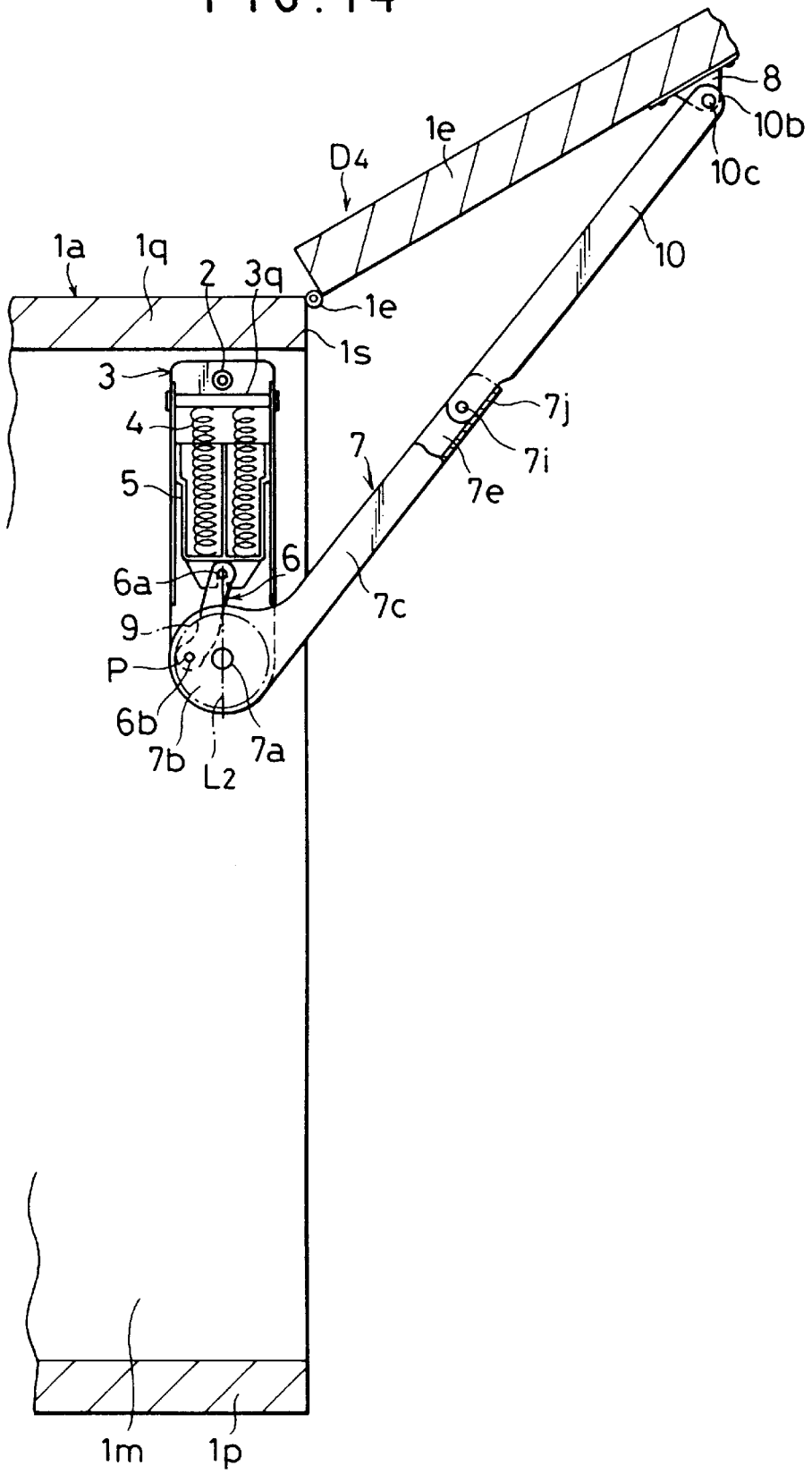
FIG. 14 is a partly cut-away schematic lateral view of an pull-sideways-and-open type cabinet door prop unit of FIG. 12 in the final stage of the door opening motion.

Now, a pull-sideways-and-open type door prop unit according to the eleventh aspect of the invention will be described. FIGS. 12 through 14 illustrate a pull-sideways-and-open type door D3 in cross section under consideration. There is shown a cabinet 1*a* comprising a pair of oppositely disposed lateral walls 1*p* and 1*q*, a top wall (not shown) and a bottom wall 1*m* that define an opening 1*k* facing forward. The door proper 1*e* is swingably secured to the front edge 1*s* of the lateral wall 1*q* by means of a hinge 1*d*.

The illustrated embodiment of door prop unit is essentially identical with the one described above by referring to FIG. 9, although the fitting case 3 is rigidly secured to inner surface of the top wall and/or that of the bottom wall 1*m*. Thus, the movable spring holder 5 is urged toward the lateral wall 1*p* by the compression springs 4 and the extension arm 10 is pivotably linked to the anchor pin bearing 8 on the door. When the door is in the completely closed state as shown in FIG. 12, the arm section 7*c* and the extension arm 10 are oblique relative to each other but the compression springs 4 are expanded to urge the movable spring holder 5 toward the lateral wall 1*p* so that the pivot pin P where the link arm 6 and the base section 7*b* of the swing arm 7 are linked by means of a link pin 6*b* is located closer to the door relative to the horizontal axial line L2.

Thus, in the closed state of the door, the base section 7*b* is driven to rotate in the direction of arrow R5 by the link arm 6 under the effect of the relatively small resilient force of the compression springs 4 and the arm section 7*c* is driven to rotate in the direction of arrow R6 to maintain the door 1*e* under the closed state.

If, under this condition, the door 1*e* is turned sideways to open, it gets into the initial stages of the door opening motion as shown in FIG. 13, where the pivot point P is moved onto the horizontal axial line L2 to provide a change point. After passing by the change point, the door opening motion gets into the subsequent stages until the door becomes fully opened, when the arm section 7*c* and the extension arm 10 are aligned to expand the compression springs 4 and the pivot point P is located away from the door relative to the horizontal axial line L1 as shown in FIG. 14 to transmit a rotary force trying to open the door to the swing arm 7 so that the door is held to its opened position. The door 1*e* and the opening of the cabinet preferably shows an angle greater than 90 degrees in the fully opened position of the door as shown in FIG. 14.

The door can be moved from the fully opened position toward the closed position simply by releasing the arm section 7*c* and the extension arm 10 from the aligned state shown in FIG. 14 to an obliquely positioned state shown in FIG. 13. Then, the door 1*e* is automatically closed and held to the closed state under the effect of the resilient force of the compression springs 4 as described earlier.

A pull-sideways-and-open type door prop unit according to the twelfth aspect of the invention is realized by adding a damper mechanism 9 to a door prop unit according to the ninth aspect of the invention and, therefore, its effects are substantially same as those described above by referring to the sixth, eighth and tenth aspects of the invention.

Figure 15:
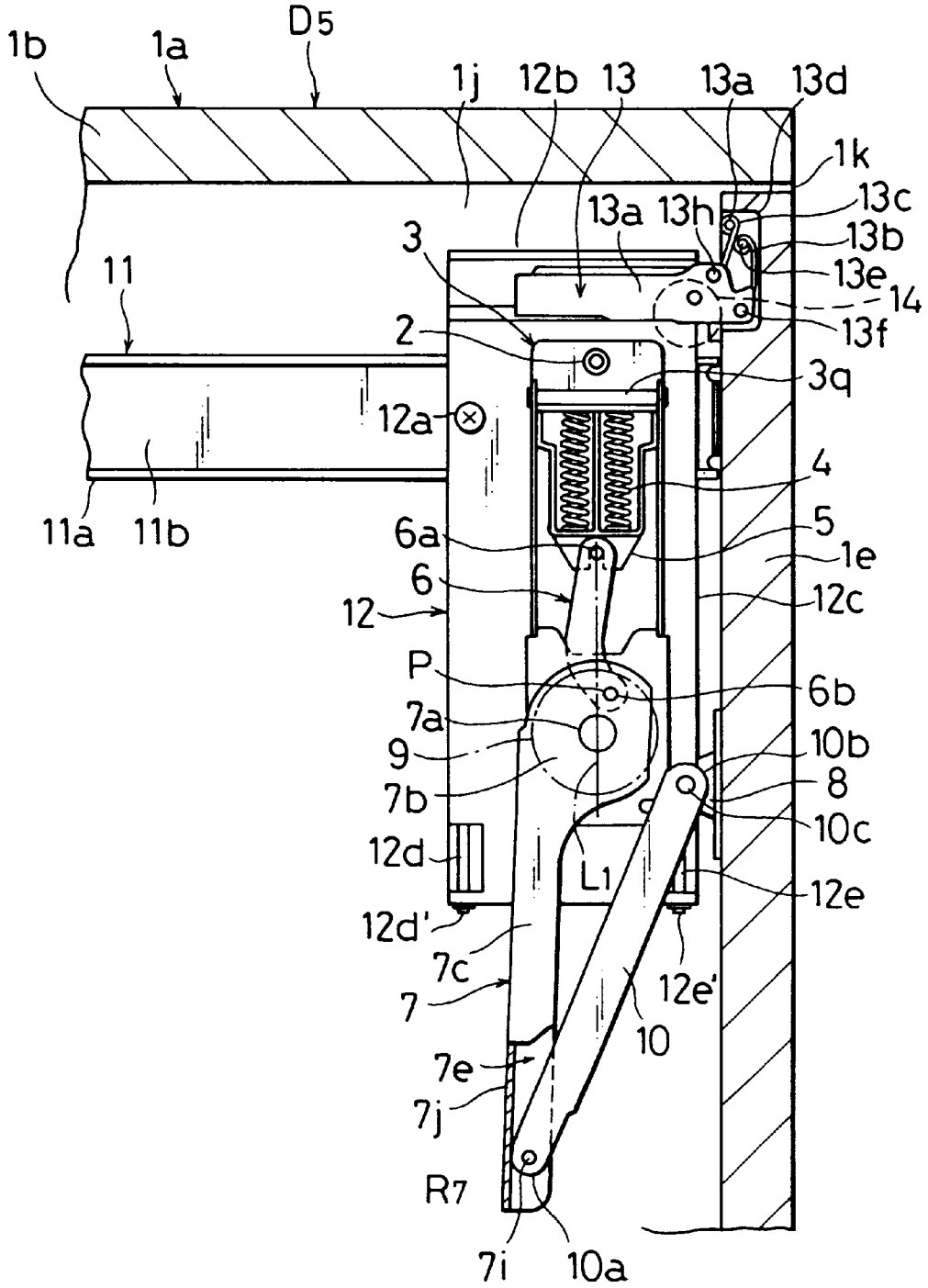
FIG. 15 is a partly cut-away schematic lateral view of an pull-up-and-store-under-the type cabinet door prop unit according to the thirteenth or fourteenth aspect of the invention in the closed state.
Figure 16:
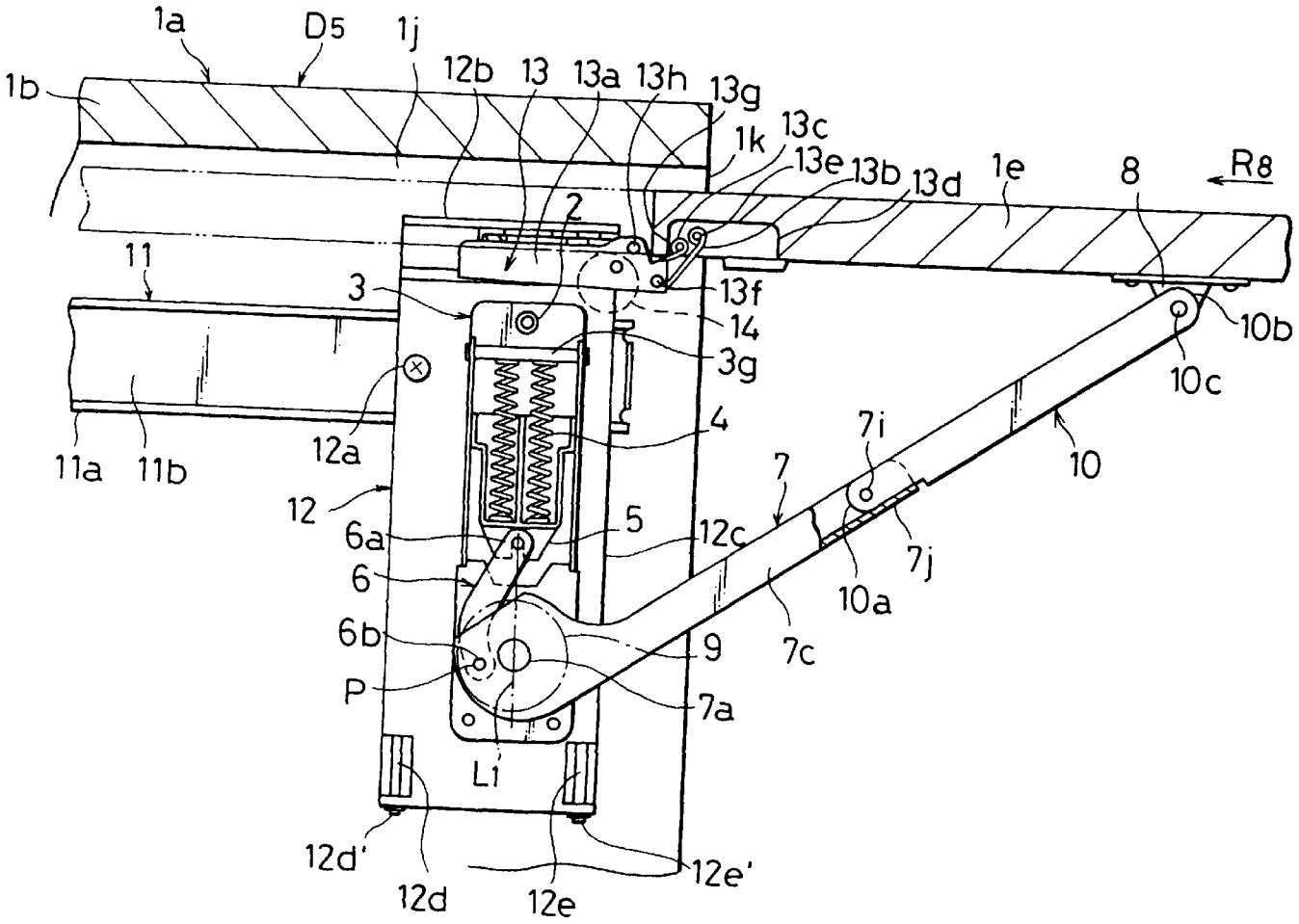
FIG. 16 is a partly cut-away schematic lateral view of an pull-up-and-store-under-the type cabinet door prop unit of FIG. 15 in the final stage of the door opening motion.
Figure 17:
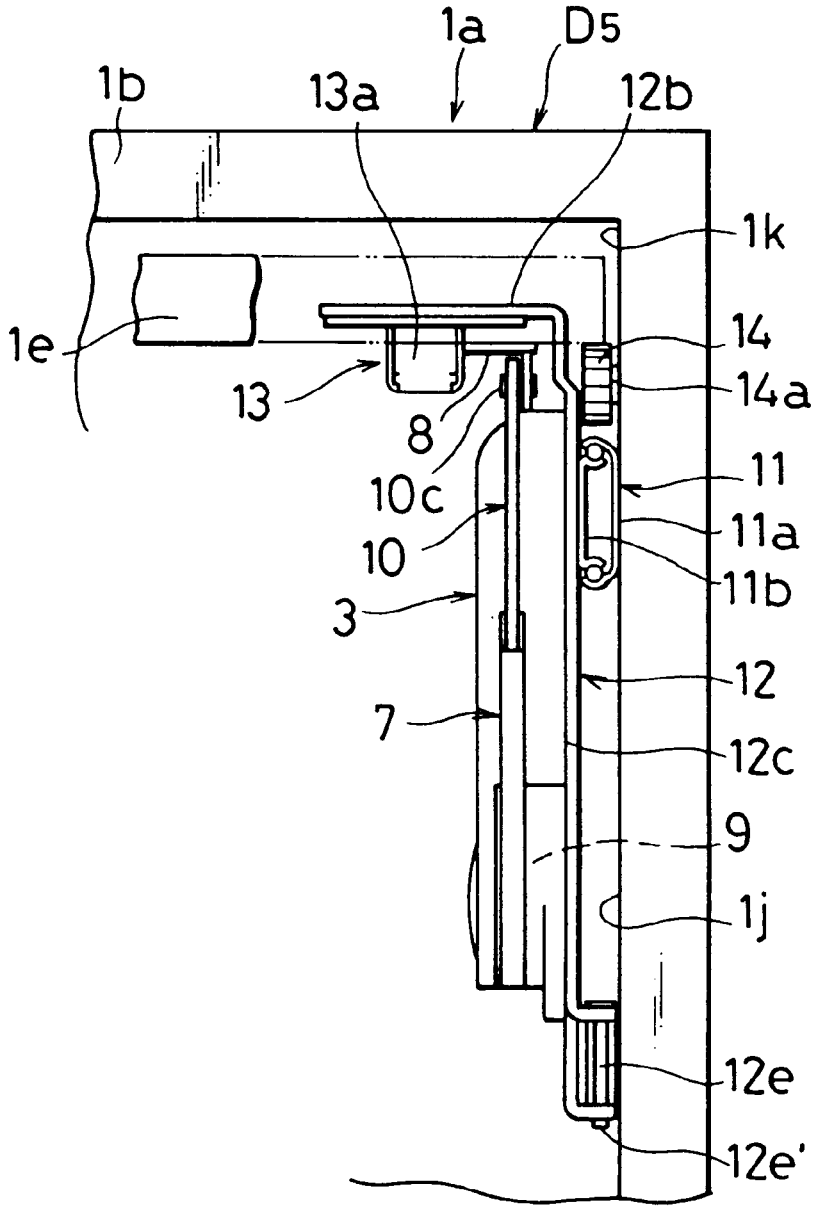
FIG. 17 is a partly cut-away schematic lateral view of an pull-up-and-store-under-the type cabinet door prop unit of FIG. 16 as viewed from the opposite direction.

Now, a pull-up-and-store-under-the-top type door prop unit according to the eleventh aspect of the invention will be described. FIGS. 15 through 17 illustrate a pull-up-and-store-under-the-top type door D8 in cross section under consideration that has functionally much in common with a pull-up-and-open type door D3 described above by referring to FIGS. 9 through 11. There is shown a cabinet 1*a* comprising a pair of oppositely disposed lateral walls, a rear wall, a top wall 1*b* and a bottom wall that define an opening 1*k* facing forward. A sliding rail assembly 11 is horizontally arranged on the inner surface 1*j* of one of the lateral walls, running from the opening 1*k* toward the rear wall of the cabinet 1*a*.

The sliding rail assembly 11 comprises an outer rail 11*a* rigidly secured to the inner surface 1*j* of the lateral wall and an inner rail 11*b*, to which a bracket 12 is rigidly fitted at a position close to the opening 1*k* of the cabinet by means of screws 12*a*.

As shown in FIG. 17, said bracket 12 has a horizontal member 12*b* to be fitted to the top wall and an upright member 12*c* to show an inverted L-shape. There is also provided a sliding hinge mechanism 13 comprising a base member 13*a* fitted to the lower surface of the horizontal member 12*b*. Said inner rail 11*b* is rigidly secured to the outer surface of the upright member 12*c* of the bracket 12.

A fitting cup 13*d* is pivotably linked to the base member 13*a* of the sliding hinge 13 by way of first and second link members 13*b* and 13*c* and the door 1*e* and the bracket 12 are connected together by means of the sliding hinge mechanism 13. Reference symbols 13*e*, 13*f*, 13*g* and 13*h* in FIGS. 15 through 17 denote link pins of the first and second link members 13*b* and 13*c*.

As shown in FIG. 15, a pair of revolving members 12*d* and 12*e* are rotatably fitted to respective lower lateral portions of the upright member 12*c* of the bracket 12 by means of respective vertical pins 12*d*′ and 12*e*′. As shown in FIG. 17, the revolving members 12*d* and 12*e* are made to revolvably abut the inner surface 1*j* of the lateral wall.

Reference numeral 14 denotes a door bearing roller revolvably held by a horizontal spindle 14*a* extending between the inner surfaces 1*j* of the lateral walls. As will be described hereinafter, the door 1*e* is horizontally pushed into the cabinet 1*a* for storage as it moves on the door bearing roller 14.

Thus, with a cabinet door prop unit according to the thirteenth aspect of the invention, the fitting case 3 is not directly fitted to the inner surface of one of the lateral walls of the cabinet but rigidly secured to the upright member 12*c* of the bracket 12 by means of screws 2. Otherwise, it is like the one illustrated in FIG. 4 for an over-the-top type cabinet door and arranged upside down relative to the one illustrated in FIG. 6 for a pull-down-and-open type cabinet door and the distal end 10*b* of the extension arm 10 is linked to the anchor pin bearing 8 on the door 1*e* by means of an anchor pin 10*c*.

When the door is closed as shown in FIG. 13, the arm section 7*c* and the extension arm 10 are oblique relative to each other to compress the compression springs 4 and the pivot point P linking the link arm 6 and the base section 7*b* of the swing arm 7 is located closer to the door relative to the vertical axial line L1.

Thus, the base section 7*b* is urged to rotate in the direction of arrow R7 by the resilient force of the compression springs 4 and hence the door 1*e* is held to its closed position. As the door 1*e* is pulled up to open by the user holding the lower end thereof, the pivot point P is moved onto the vertical axial line L1 to provide a change point there in the initial stages of the door opening motion as shown in FIG. 10. Then, after the pivot point P passes by the change point in the subsequent stages of the door opening motion, the arm section 7*c* and the extension arm 10 become aligned with each other to hold the door 1*e* in a horizontal state as shown in FIG. 16.

Note that the opening motion of the door 1*e* is provided by the rotary operation of the first link member 13*b*, the second link member 13*c* and the fitting cup 13*d*. The compression springs 4 are expanded and the pivot point P is moved away from the door relative to the vertical axial line L1 to urge the swing arm 7 to rotate and open the door until the door is brought to a horizontal position and become fully opened so that the door is held to its fully opened and horizontal position after the sliding hinge mechanism 13 stops rotating.

Figure 18:
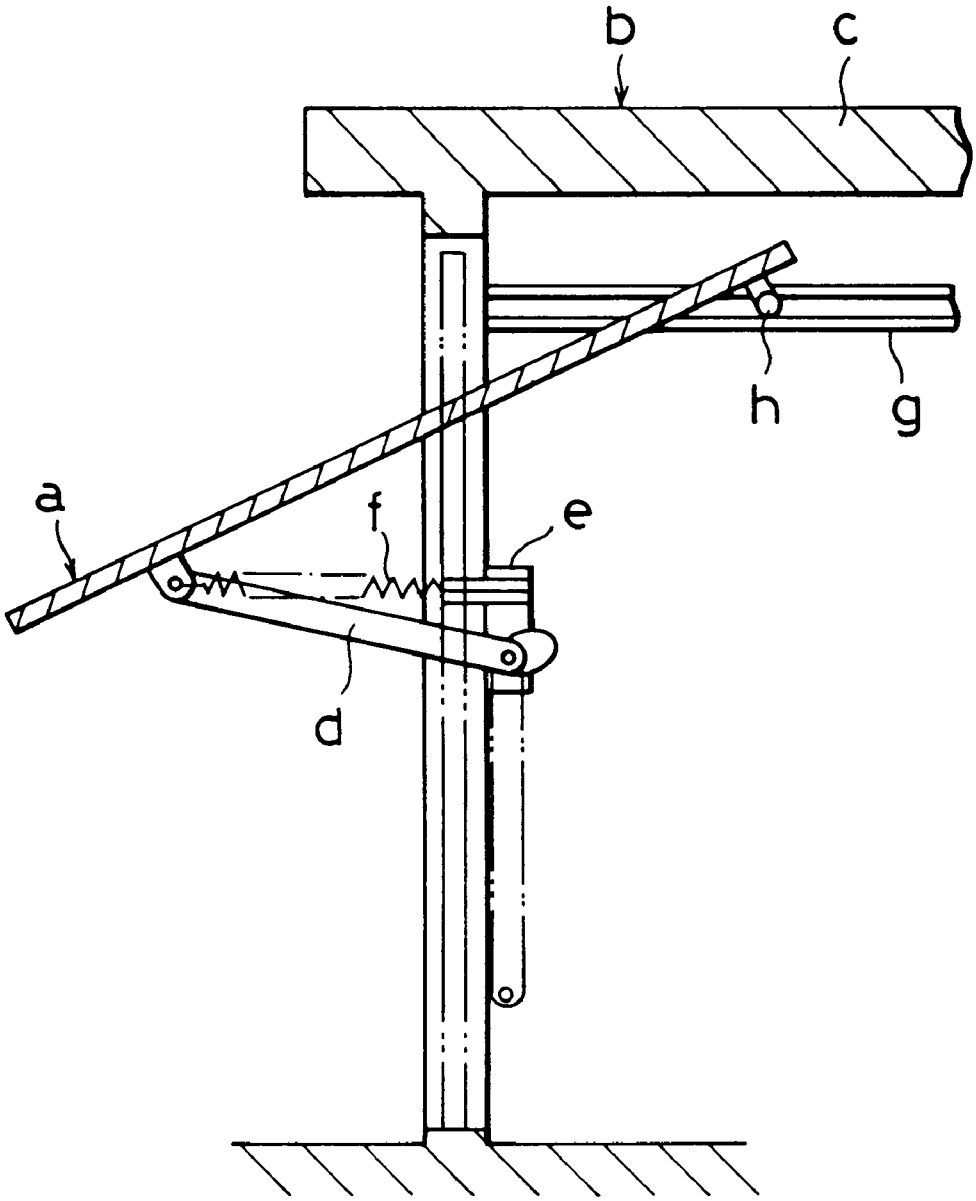
FIG. 18 [ PRIOR ART ]
FIG. 18 is a schematic lateral view of a known over-the-top type cabinet door prop unit.

Then, as the door 1*e* shown in FIG. 16 is pushed in the direction of arrow R8, the lateral pushing force is transmitted to the bracket 12 by way of the sliding hinge mechanism 13, the swing arm 7 and the fitting case 3 so that the bracket 12 is moved into the cabinet 1*a* by the sliding motion of the inner rail 11*b* along the outer rail 11*a* of the sliding rail assembly 11 and the revolving motion of the revolving members 12*d* and 12*e* arranged on the bracket 12. Thus, the horizontally positioned door 1*e* is also moved into the cabinet 1*a* along the direction of arrow R8 in FIG. 18 until it is completely housed in the cabinet 1*a* as it is supported at the lower surface thereof by the door bearing roller 14 that is also revolving.

For closing the door housed in the cabinet, the user simply has to pull out the door 1*e* from the cabinet 1*a* and then release the arm section 7*c* and the extension arm 10 from the aligned condition. Then, as the door 1*e* turns downward by its own weight, the swing arm 7 is swung reversely to move up the movable spring holder 5 by way of the link arm 6 to consequently compress the compression springs 4 so that the closing motion of the door 1*e* is made very slow and, once the door is closed, it is held to its closed position.

A pull-up-and-store-under-the-top type door prop unit according to the fourteenth aspect of the invention is realized by adding a damper mechanism 9 to a door prop unit according to the ninth aspect of the invention and, therefore, its effects are substantially same as those described above by referring to the sixth, eighth and tenth aspects of the invention.

[Advantages of the Invention]

As described above in detail, according to the first aspect of the invention, there is provided an over-the-top type cabinet door that can be used smoothly once the fitting case of the cabinet door prop unit is rigidly fitted to the inner surface of one of the lateral walls of the cabinet and the distal end of the swing arm of the unit is pivotably fitted to the door in a simple operation. With such an arrangement, the door prop unit has a neat appearance and is free from the risk of smashed fingers.

Additionally, since the door prop unit comprises compression springs urging the swing arm by way of a link mechanism, the door may be opened and stored easily on the top wall of the cabinet easily and opened very slowly.

According to the second aspect of the invention, since a cabinet door prop unit as described above in terms of the first aspect of the invention is provided with a damper mechanism, the swing motion of the swing arm is damped and slowed without requiring any user's effort when the cabinet door is closed.

With an over-the-top type cabinet door prop unit according to the third aspect of the invention, the door is totally free from the resilient force of the compression springs in the subsequent stages of the door opening motion until the door is placed on the top wall of the cabinet so that the door can be handled in an appropriate manner when it is stored on the top wall and pulled out with little effort from the top wall.

According to the fourth aspect of the invention, the additional effect as described above for the second aspect of the invention is also obtained because a damper mechanism is combined with a door prop unit according to the third aspect of the invention.

According to the fifth aspect of the invention, there is provided a pull-down-and-open type cabinet door that can be used smoothly once the fitting case of the cabinet door prop unit is rigidly fitted to the inner surface of one of the lateral walls of the cabinet and the distal end of the swing arm of the unit is pivotably fitted to the door in a simple operation. With such an arrangement, the door prop unit has a neat appearance and is free from the risk of smashed fingers.

According to the sixth aspect of the invention, the additional effect as described above for the second aspect of the invention is also obtained because a damper mechanism is combined with a door prop unit according to the fifth aspect of the invention.

According to the seventh aspect of the invention, the door prop unit is so arranged that the compression springs are compressed when the door is closed and expanded when the door is opened and the pivot point of the link pin is moved appropriately relative to the horizontal axial line in the door opening and closing motion. Thus, a pull-up-and-open type top cabinet door according to this aspect of the invention can be securely held in the closed or opened state and the door closing motion can be conducted very slowly.

According to the eighth aspect of the invention, the additional effect as described above for the second aspect of the invention is also obtained because a damper mechanism is combined with a door prop unit according to the seventh aspect of the invention.

With a door prop unit for a pull-up-and-open type front side cabinet door according to the ninth aspect of the invention, the pivot point is moved appropriately relative to the vertical axial line and the compression springs are expanded and compressed respectively when the door is opened and closed so that the door is securely held to its closed position and a change point is provided for the initial stages of the door opening motion. With the arrangement, the subsequent stages of the door opening motion and all the stages of the door closing motion are aided by the compression springs. Additionally, the door can be securely held to the opened position and the operation of closing the door can be conducted very slowly.

According to the tenth aspect of the invention, the additional effect as described above for the second aspect of the invention is also obtained because a damper mechanism is combined with a door prop unit according to the ninth aspect of the invention.

With a pull-sideways-and-open type cabinet door according to the eleventh aspect of the invention, the compression springs are expanded when the door is closed and compressed when the door is opened and the fitting case is rigidly secured either to the top wall or the bottom wall in addition to the arrangement that the pivot point is moved appropriately relative to the horizontal axial line. Thus, the net effect is substantially same as its counterpart for the fifth aspect of the invention.

According to the tenth aspect of the invention, the additional effect as described above for the second aspect of the invention is also obtained because a damper mechanism is combined with a door prop unit according to the ninth aspect of the invention.

With a pull-up-and-store-under-the-top type cabinet door prop unit according to the thirteenth aspect of the invention, once a bracket arranged on a sliding rail mechanism is rigidly secured to the cabinet and linked to a hinge and slide mechanism and the extension arm is pivotably fitted to the anchor pin bearing of the door in a simple operation, the door can be held to its closed position and the subsequent stages of the door opening motion are aided by the compression springs all the way to the horizontal position of the door. Additionally, the operation of storing the door under the top wall can be conducted easily and the door can be closed very slowly.

According to the fourteenth aspect of the invention, the additional effect as described above for the second aspect of the invention is also obtained because a damper mechanism is combined with a door prop unit according to the thirteenth aspect of the invention

What is claimed is:

1. A cabinet having two lateral walls, a top wall, and an over-the-top cabinet door with an over-the-top door prop unit comprising a fitting case rigidly fitted to an inner surface of one of the lateral walls of the cabinet, a movable spring holder vertically movable relative to the fitting case containing it and urged downward by compression springs, a link arm pivotably linked at an upper end to the movable spring holder by means of a pivot pin and a swing arm swingable around an arm spindle located in a lower portion of the fitting case and having a base section surrounding the arm spindle and linked to the lower end of said link arm by means of a link pin and an arm section extending from the base section and pivotably linked at a distal end thereof by means of an anchor pin to an anchor pin bearing secured to the over-the-top cabinet door and that a pivot where the link arm and the base section of the swing arm is linked by means of the link pin is located closer to the cabinet door relative to a vertical axial line connecting said pivot pin and said arm spindle when the over-the-top cabinet door is closed and during an opening motion of the door said pivot is moved onto said vertical axial line in the initial stages of the opening motion of the cabinet door and then further away from the cabinet door relative to said vertical axial line in the subsequent stages of the opening motion of the cabinet door until the cabinet door is placed on the top wall of the cabinet.

2. The over-the-top cabinet door prop unit of claim 1 wherein said arm spindle is linked to a rotary shaft of a damper mechanism provided in the fitting case and designed to exert a damping effect on the closing or closing and opening motion of the cabinet door by means of viscous fluid.

3. The over-the-top cabinet door prop unit of claim 1 wherein a vertical 'slot guides said spring holder within said fitting case in such a way that said downwardly urging motion of said compression springs is blocked at a limit by the fitting case and the position of the pivot pin is lowered by a predetermined distance from an original upper position as the cabinet door is opened by hand in the final stages of the opening motion of the cabinet door until the cabinet door is placed on the top wall of the cabinet.

4. The over-the-top cabinet door prop unit of claim 3 wherein said arm spindle is linked to a rotary shaft of a damper mechanism provided in the fitting case and designed to exert a damping effect on the closing or closing and opening motion of the cabinet door by means of viscous fluid.

* * * * *